US012753992B2

(12) United States Patent
Backs et al.

(10) Patent No.: US 12,753,992 B2
(45) Date of Patent: Oct. 6, 2026

(54) METHOD AND SYSTEM FOR A MISSILE ADAPTER

(71) Applicant: DRS Sustainment Systems, Inc., Saint Louis, MO (US)

(72) Inventors: Kaci Backs, Glen Carbon, IL (US); Jeffrey S. Fitzgerald, Florissant, MO (US)

(73) Assignee: DRS Sustainment Systems, Inc., Saint Louis, MO (US)

( * ) Notice: Subject to any disclaimer, the term of this patent is extended or adjusted under 35 U.S.C. 154(b) by 0 days.

(21) Appl. No.: 19/216,509

(22) Filed: May 22, 2025

(65) Prior Publication Data

US 2025/0362109 A1 Nov. 27, 2025

Related U.S. Application Data

(60) Provisional application No. 63/651,265, filed on May 23, 2024.

(51) Int. Cl.
*F41F 3/052* (2006.01)

(52) U.S. Cl.
CPC ..... *F41F 3/052* (2013.01)

(58) Field of Classification Search
CPC ..... F41F 3/052; F41F 3/042; F41F 3/065
USPC ..... 89/1.816, 1.8, 1.817, 1.819
See application file for complete search history.

(56) References Cited

U.S. PATENT DOCUMENTS 6,330,866 B1 * 12/2001 Cipolla ..... F41A 9/09 114/316
6,427,574 B1 * 8/2002 Callahan ..... F41F 3/07 89/1.817

OTHER PUBLICATIONS

EP 2312256 A2 (Patent Publication & English Translation) (Year: 2011).*
KR 102194735 B1 (Patent Publication & English Translation) (Year: 2020).*

* cited by examiner

*Primary Examiner* — Reginald S Tillman, Jr.
(74) *Attorney, Agent, or Firm* — Kilpatrick Townsend & Stockton LLP LLP

(57) ABSTRACT

Embodiments described herein n adapter is configured to receive a missile therein. The adapter includes a support member including an internal surface, an external surface, a fore portion, and an aft portion. The external surface includes one or more guide pins along the fore portion configured to slide through one or more corresponding guide rails on a receiving dual column chassis of a launcher, a pilot feature on the fore portion engages with the launcher, an extension portion, an electrical interface configured to couple to the launcher, and a second retention mechanism configured to retain the aft portion of the adapter in the receiving dual column chassis. The internal surface include lower guide rails, a fore alignment pin, a fore strike plate, an electrical interface guide pin, a first retention mechanism, and an aft mechanical stop feature configured to engage the first retention mechanism.

17 Claims, 17 Drawing Sheets

METHOD AND SYSTEM FOR A MISSILE ADAPTER

CROSS-REFERENCES TO RELATED APPLICATIONS

This application claims priority to U.S. Provisional Patent Application No. 63/651,265, filed on May 23, 2024, entitled "Method And System For A Missile Adapter," the disclosure of which is hereby incorporated by reference in its entirety for all purposes.

BACKGROUND OF THE INVENTION

Missile launchers are generally designed to load and launch specific missiles. The Upgraded Tube-Launched, Wireless-Guided Missile Launcher (UTML) was developed to reduce weight and maximize design modularity with the intent of improving maintainability and sustainability within the U.S. Army while maintaining the usability of the current maintenance toolkits. The UTML launches the Tube-Launched, Optically Tracked, Wire-Guided (TOW) Missile. Despite the progress made in the area of missile launcher technology, there is a need in the art for improved methods and systems related to missile launcher technology.

SUMMARY OF THE INVENTION

The present disclosure relates generally to methods and systems related to missile launcher adapters. More particularly, embodiments of the present invention provide methods and systems that can be used to enable a missile launcher to load and launch alternative types of missiles in addition to the specific model of missile for which the launcher was designed. The disclosure is applicable to a variety of applications in missile and associated launcher design and development.

According to one embodiment, an adapter is configured to receive a missile therein. The adapter includes a support member including an internal surface, an external surface, a fore portion, and an aft portion. The external surface includes one or more guide pins along the fore portion configured to slide through one or more corresponding guide rails on a receiving dual column chassis of a launcher, a pilot feature on the fore portion engages with the launcher, an extension portion, an electrical interface configured to couple to the launcher, and a second retention mechanism configured to retain the aft portion of the adapter in the receiving dual column chassis. The internal surface includes lower guide rails, a fore alignment pin, a fore strike plate, an electrical interface guide pin, a first retention mechanism, and an aft mechanical stop feature configured to engage the first retention mechanism.

The adapter may optionally include embodiments where the support member defines access cutouts that enable access to the internal surface of the support member. The adapter may further include embodiments where the aft mechanical stop feature is a handle locking mechanism configured to engage with the missile. A central axis of the pilot feature may be laterally offset and transversely offset from a central axis of the support member. The missile may be a Spike Long Range 2 (LR2) missile. The launcher may be a modified Upgraded Tube-Launched, Wireless-Guided Missile Launcher (UTML).

According to another embodiment, a system includes a missile launcher operable to receive a first missile and an adapter configured to couple to the missile launcher. The adapter enables the missile launcher to be operable to receive a second missile different from the first missile.

The system may optionally include embodiments where the adapter includes an external surface and an internal surface. The external surface may include one or more guide pins along a fore portion of the adapter configured to slide through one or more corresponding guide rails on a receiving dual column chassis of the missile launcher. The external surface may also include a pilot feature on the fore portion that engages with the missile launcher, an extension portion, an electrical interface configured to couple to the missile launcher, and a second retention mechanism configured to retain an aft portion of the adapter in the receiving dual column chassis. The internal surface may include lower guide rails, a fore alignment pin, a fore strike plate, an electrical interface guide pin, a first retention mechanism, and an aft mechanical stop feature configured to engage the first retention mechanism. The launcher may include side guide rails, a pilot feature, one or more aft capture features, a first electrical interface configured to be coupled to the first missile, and a second electrical interface configured to be coupled to the second missile. The missile launcher may be a modified UTML. The first missile may be a TOW missile. The second missile may be a Spike LR2 missile.

According to yet another embodiment, a missile launcher is configured to receive a first missile and an adapter configured to receive a second missile. The missile launcher includes a retainer component configured to transition from a first missile configuration to a second missile configuration. The missile launcher is configured to receive the first missile in the first missile configuration and the second missile in the second missile configuration, side guide rails, a pilot feature, one or more aft capture features, a first electrical interface configured to be coupled to the first missile, and a second electrical interface configured to be coupled to the second missile.

The missile launcher may optionally include embodiments in which the pilot feature is configured to be interfaced with a pilot feature on each of the first missile and the adapter. The side guide rails may be configured to guide pins on each of the first missile and the adapter. The missile launcher may be a modified UTML. The first missile may be a TOW missile. The second missile may be a Spike LR2 missile.

Numerous benefits are achieved by way of the present disclosure over conventional techniques. For example, embodiments of the present invention enable missile launchers to launch alternative missiles. In contrast, conventional missile launcher systems are specifically designed for a particular missile and are unable to accommodate alternative missile types. The adapter described herein advantageously enables a missile launcher to launch an alternative missile other than the missile for which the launcher was designed. As an example, since TOW missiles may not be optimal for all circumstances, embodiments of the present invention adapt a UTML launcher to load and launch one or more alternative missile varieties including the Spike Long Range missile. These and other embodiments of the disclosure, along with many of its advantages and features, are described in more detail in conjunction with the text below and corresponding figures.

DESCRIPTION OF THE DRAWINGS

Embodiments of the present invention are described below with reference to the attached drawings, in which.

DETAILED DESCRIPTION OF SPECIFIC EMBODIMENTS

Various embodiments of the present disclosure describe an adapter that provides an existing launcher dual missile capability. Specifically, the adapter described herein enables Spike Long Range 2 (LR2) missiles to be launched from a UTML platform. According to at least some embodiments, minor modifications to the existing UTML platform further enable the dual missile capability. The resulting base launcher, in combination with the adapter described herein, is capable of firing either TOW or Spike LR2 missiles. The temporary installation of an adapter assembly enables conversion between the relevant interfaces. The missiles themselves provide limited options for modifications and are characterized by an extremely tight fitment. In some embodiments, the adapter is a tightly controlled, unitary aluminum casting that builds in all interface conversion features into the adapter and removes many sources of interference, errors, and assembly issues to ensure proper installation and performance of both missiles.

At least some of the embodiments described herein include an adapter that is easily re-configurable in the field and requires no special (e.g., additional) tools. The adapter is an assembly that converts the internal mechanical and electrical interfaces of the missile launcher from being TOW capable to being Spike LR2 capable. The adapter replicates the necessary external mechanical interface features of the TOW missile canister to enable loading into the missile launcher and provides the required mechanical and electrical interfaces required to enable loading of the Spike LR2 missile into the adapter and further into the missile launcher. Advantageously, the adapter described herein has no impact on existing Bradley turret control algorithms by ensuring little weight difference between the two systems. The adapter described herein provides a competitive advantage as this is the only near-term solution to enable firing of existing TOW missiles and Spike LR2 missiles. Thus, the adapter described herein provides a significant capability upgrade.

Figure 1:
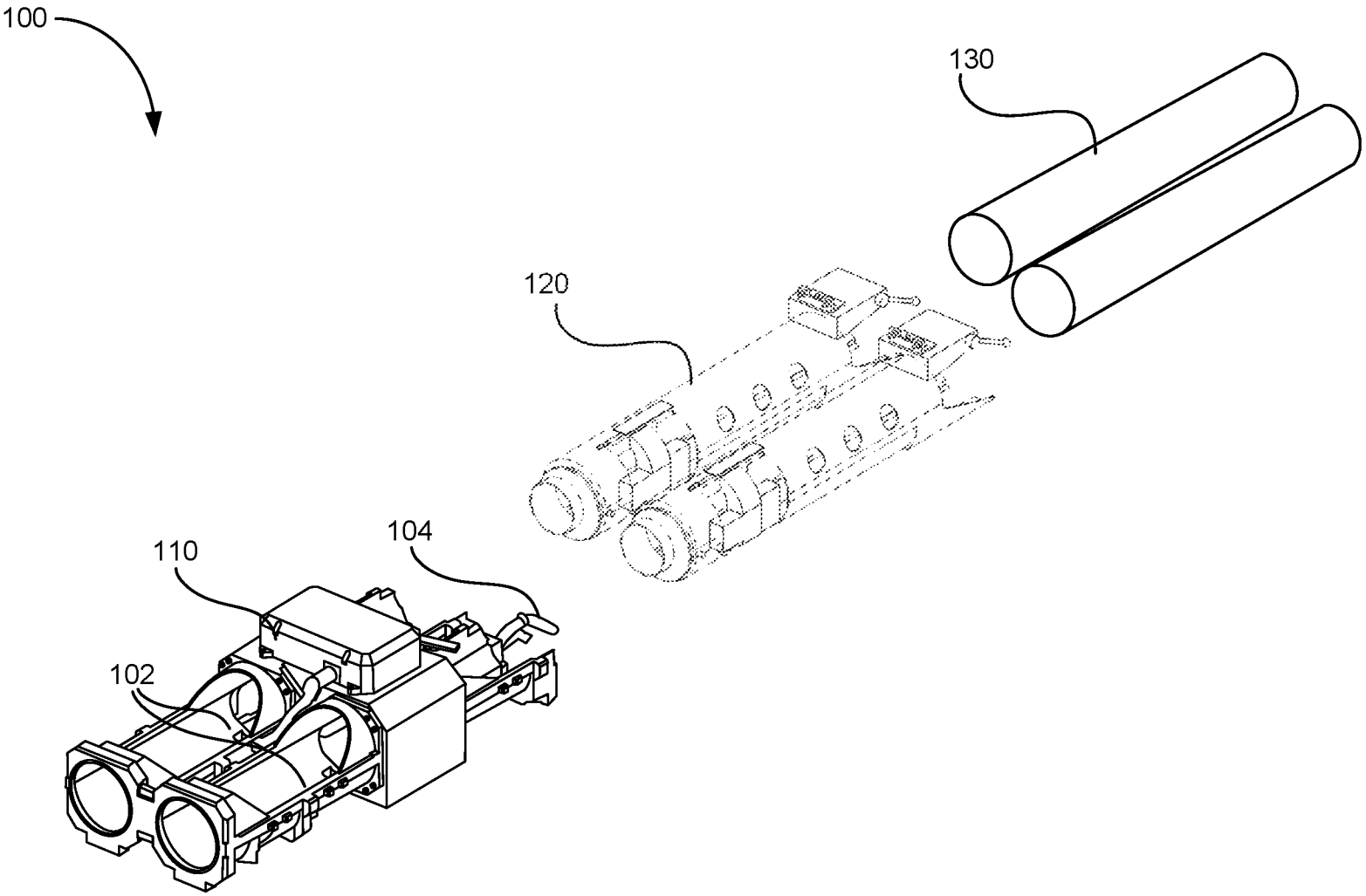
FIG. 1 is an exploded view of an embodiment of a missile adapter assembly of the present disclosure.

FIG. 1 is an exploded view of an embodiment of a missile adapter assembly of the present disclosure. The missile adapter assembly 100 includes a launcher 110 and an adapter 120 configured to receive a missile 130. In various embodiments, the launcher 110 includes a dual column chassis. According to at least some embodiments, the launcher 110 is a UTML or a modified launcher described in further detail below. The launcher 110 is configured to receive a first missile (e.g., a first type of missile) in each column 102. The first missile may be an existing TOW missile configured for use with a UTML launcher. Each column 102 is configured to receive an adapter 120. Each adapter 120 is configured to receive a missile 130. Missile 130 may be a second missile (e.g., a second type of missile). Missile 130 may be a Spike LR2 missile, in accordance with at least some embodiments of the present disclosure. Each adapter 120 is independently insertable into each column 102 of the launcher and each missile 130 is independently insertable into each adapter 120. In at least some configurations, the launcher 110 transitions from a first missile configuration to a second missile configuration to receive the adapter 120. For example, in some embodiments, a retainer component 104 of the launcher 110 may be pulled backward and downward (as shown in FIG. 1) to enable insertion of the adapter 120 and the missile 130.

Figure 2:
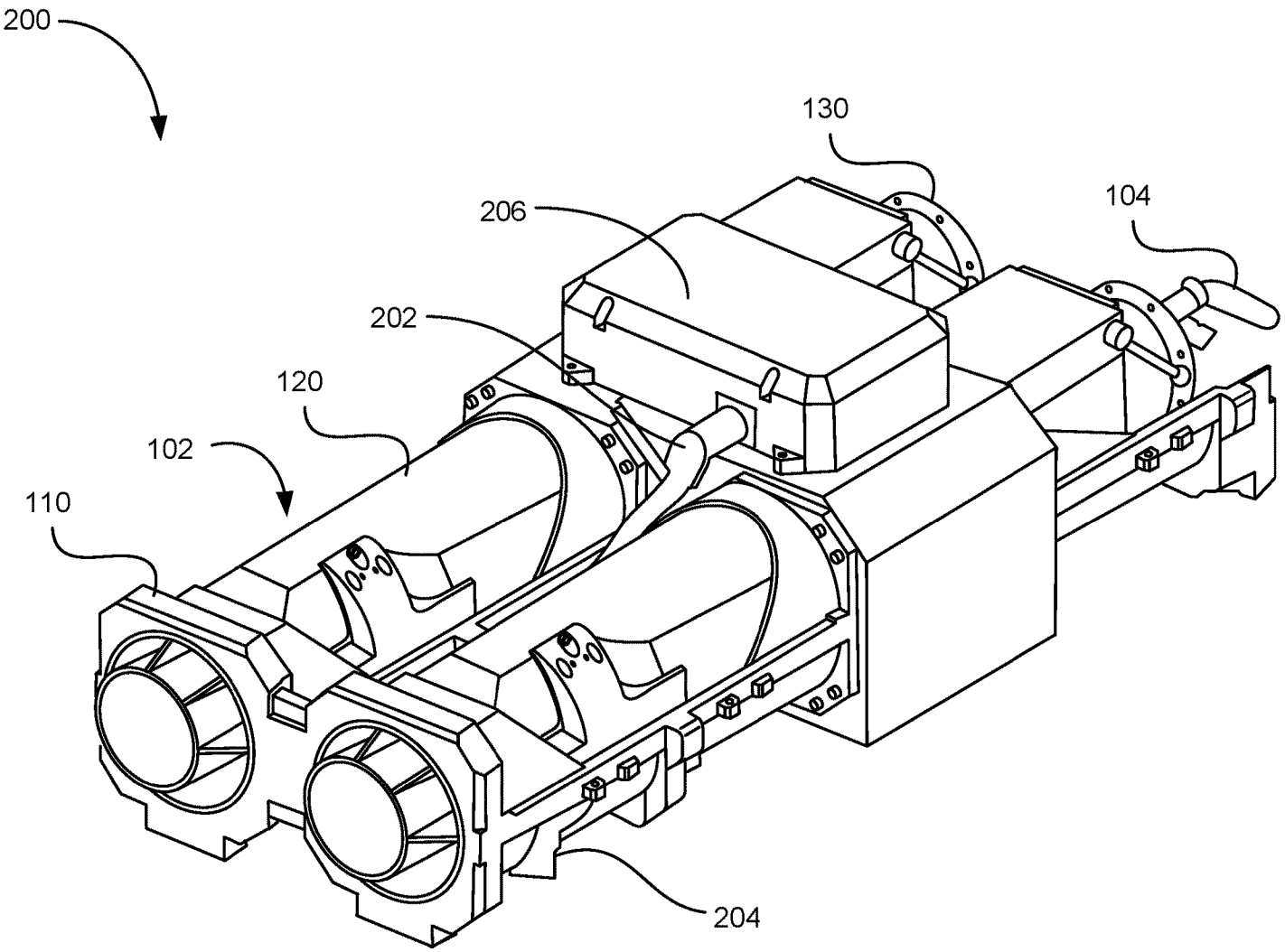
FIG. 2 is a collapsed view of an embodiment of a missile adapter assembly of the present disclosure.

FIG. 2 is a collapsed view of an embodiment of a missile adapter assembly of the present disclosure. The missile adapter assembly 200 includes a launcher 110 and an adapter 120 configured to receive a missile 130. In various embodiments, the launcher 110 includes a dual column chassis. According to at least some embodiments, the launcher 110 is a UTML or a modified launcher described in further detail below. The launcher 110 is configured to receive a first missile (e.g., a first type of missile) in each column 102. The first missile may be an existing TOW missile configured for use with a UTML launcher. Each column 102 is configured to receive an adapter 120 as shown in FIG. 2. Each adapter 120 is configured to receive a missile 130 as shown in FIG. 2. Missile 130 may be a second missile (e.g., a second type of missile). Missile 130 may be a Spike LR2 missile, in accordance with at least some embodiments of the present disclosure. Each adapter 120 is independently insertable into each column 102 of the launcher and each missile 130 is independently insertable into each adapter 120. In at least some configurations, the launcher 110 transitions from a first missile configuration to a second missile configuration to receive the adapter 120. For example, in some embodiments, a retainer component 104 of the launcher 110 may be pulled backward and downward (as shown in FIG. 2).

As shown in FIG. 2, the launcher 110 includes a first electrical interface 202 and a second electrical interface 204. The first electrical interface 202 is configured to be coupled to and provide power and/or data to a first missile (not shown) when a first missile is loaded into the launcher 110. The second electrical interface 204 is configured to be coupled to and provide power and/or data to a second missile, such as missile 130 as shown in FIG. 2. One having ordinary skill in the art would appreciate upon reading the present disclosure that either the first electrical interface 202 or the second electrical interface 204 may be utilized depending on what type of missile (e.g., a first missile or a second missile) is loaded into the launcher 110 and the unutilized electrical interface may remain disconnected. The unused electrical interface may be covered or otherwise protected with a dust cover or the like.

The launcher 110 may also include an armament control unit (ACU) 206 that actuates the electrical connectors into and out of the missiles as well as provides fire control commands to each of the two missile types when installed.

Figure 3:
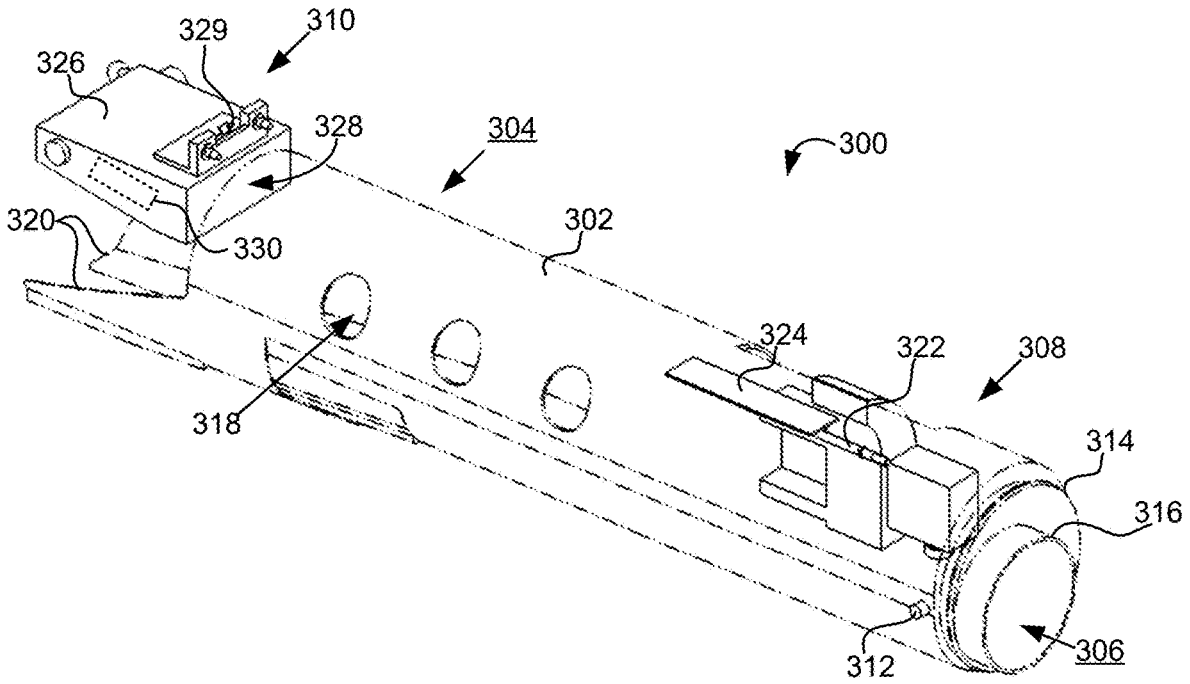
FIG. 3 is a front perspective view of an embodiment of an adapter of the present disclosure.

FIG. 3 is a front perspective view of an embodiment of an adapter of the present disclosure. Various views of adapter 300 are shown in FIGS. 3-12 of the present disclosure. It should be understood that components having similar numbering have similar functions and some components may not be visible in all views. Adapter 300 is configured to receive a missile therein. The adapter 300 includes a support member 302. The support member 302 is a substantially cylindrical support structure that surrounds and supports the missile when the missile is loaded into the adapter 300. In various embodiments, the support member 302 matches the dimensions and/or profile of a missile for which the launcher is designed to load and launch. For example, the launcher may be configured to receive a first missile having first dimensions and/or profile. The adapter 300 enables the launcher to receive a second missile having different dimensions and/or profile. The support member 302 of the adapter 300 matches the dimensions and/or profile of the first missile in order to enable loading of the second missile into the launcher.

The support member 302 includes an internal surface 306 and an external surface 304, a fore portion 308, and an aft portion 310. The internal surface 306 and the external surface 304 each include features that enable a launcher to couple to the adapter 300 and features that enable the adapter 300 to couple to and receive a missile.

In various embodiments, the external surface 304 includes one or more guide pins 312 along the fore portion 308 configured to slide through one or more corresponding guide rails on a receiving dual column chassis of a launcher. The external surface 304 of the support member 302 includes a pilot feature 314 on the fore portion 308 that engages with the launcher. For example, an outer diameter of the pilot feature 314 is less than or equal to the inner diameter of a corresponding feature on a launcher such that a snug fit exists between the pilot feature 314 and the launcher for aligning the adapter 300 in the launcher (e.g., in one of the columns of the dual column chassis of the launcher). The pilot feature 314 on the fore portion 308 of the adapter 300 is configured to be interfaced with a pilot feature on the launcher. In some embodiments, the pilot feature 314 on the fore portion 308 of the adapter 300 facilitates centering the adapter 300 and aligning the adapter 300 in the launcher. The external surface 304 also includes an extension portion 316 for aligning the adapter 300 in the receiving column of the dual column chassis of the launcher and ensuring proper performance of the missile during a launch event.

According to at least some embodiments, the support member 302 defines access cutouts 318 that enable access to the internal surface 306 of the support member 302. For example, access to the internal surface 306 may be desirable for installment of various components during manufacturing such as alignment pins, etc. The access cutouts 318 also act as lightweighting features for reducing the overall weight of the adapter 300 and/or a system including a launcher, the adapter, a missile, etc.

The internal surface 306 includes various features that enable the adapter 300 to receive a missile therein. Visible in this view, the internal surface 306 includes lower guide rails 320 that extend along a longitudinal length of the adapter 300 (e.g., of the support member 302 of the adapter 300). Lower guide rails 320 enable coarse alignment of the missile as the missile is loaded into the adapter 300. Lower guide rails 320 thus provide for mechanical alignment for the missile. A fore alignment pin 322 provides a fine alignment of the missile as the missile is loaded into the adapter 300. For example, the fore alignment pin 322 is received in a corresponding aperture in the missile for aligning the missile in the adapter 300.

The internal surface 306 also includes a fore strike plate 324. The fore strike plate 324 acts as a wear surface on the internal surface 306. For example, the fore strike plate 324 reduces wear and breakdown of the internal surface 306 of the adapter 300 as missiles are loaded and launched in a manner that would be appreciated by one having ordinary skill in the art upon reading the present disclosure.

The support member 302 includes an aft mechanical stop feature 326. The aft mechanical stop feature 326 includes a locking pin system on the internal surface 306 of the support member 302. In at least some embodiments, the mechanical stop feature 326 is a handle locking mechanism 327 illustrated in FIG. 4 configured to engage the missile when the missile is loaded in the adapter 300. The mechanical stop feature 326 is configured to engage with a first retention mechanism 328 that maintains the missile in the adapter 300. For example, the first retention mechanism 328 may be a cross-pin that the mechanical stop feature 326 engages with when the handle portion of the mechanical stop feature 326 is in an engaged position (such as the position shown at least in FIGS. 3 and 4). The internal surface 306 of the support member 302 may also include a second retention mechanism 330 configured to retain the aft portion 310 of the adapter 300 in the receiving column of the dual column chassis of the launcher. In various embodiments, the second retention mechanism 330 may include spring-loaded pins or other retaining mechanism for locking the adapter 300 within the launcher.

Figure 14A:
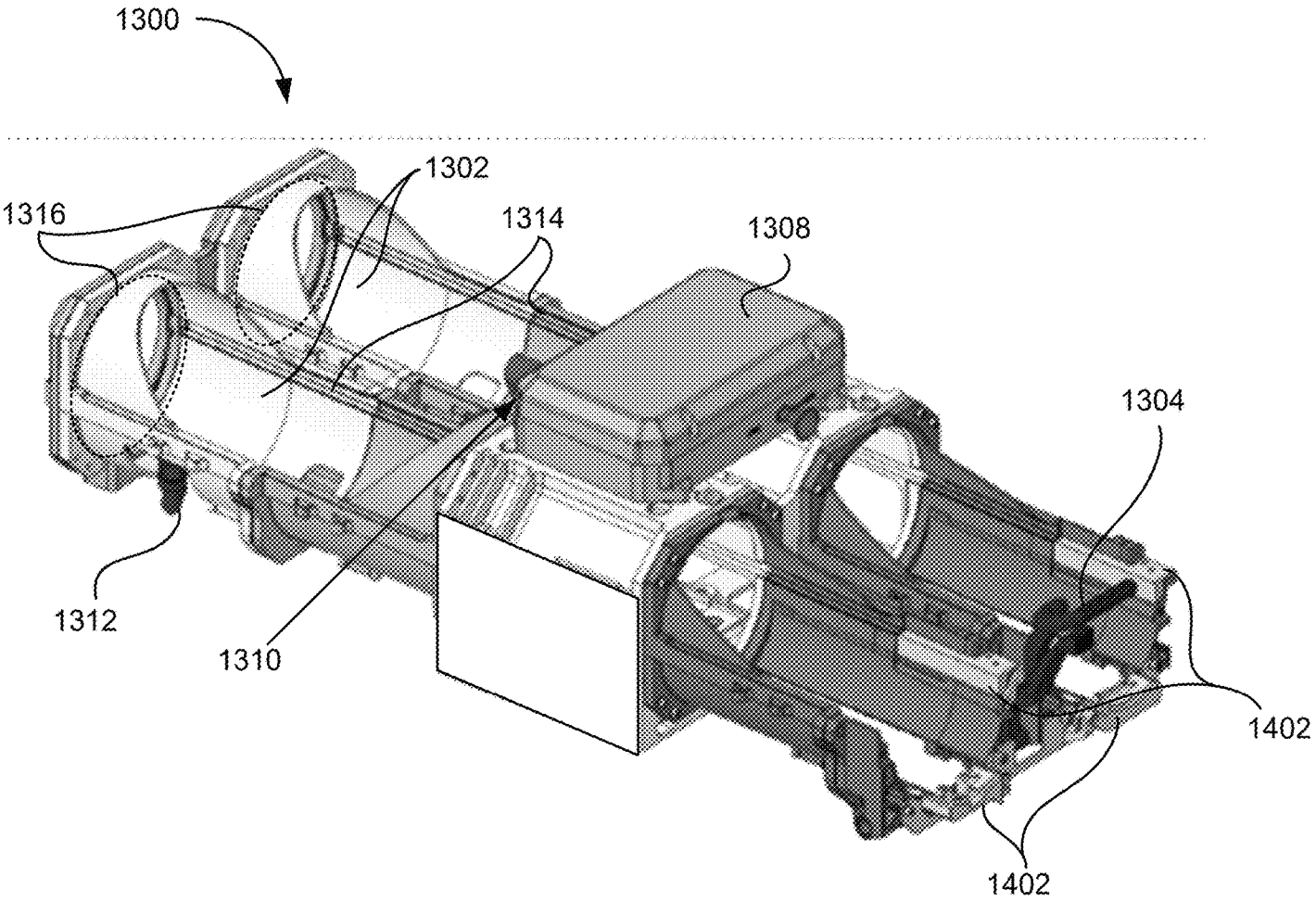
FIG. 14A is a rear perspective view of an embodiment of a modified double chassis of the present disclosure.

According to various embodiments, the mechanical stop feature 326 further includes a single swing-bolt style latch 329. The single swing-bolt style latch 329 may be interchangeably used with a double swing-bolt style latch 331 as shown in FIG. 14D according to any of the embodiments described herein.

Figure 4:
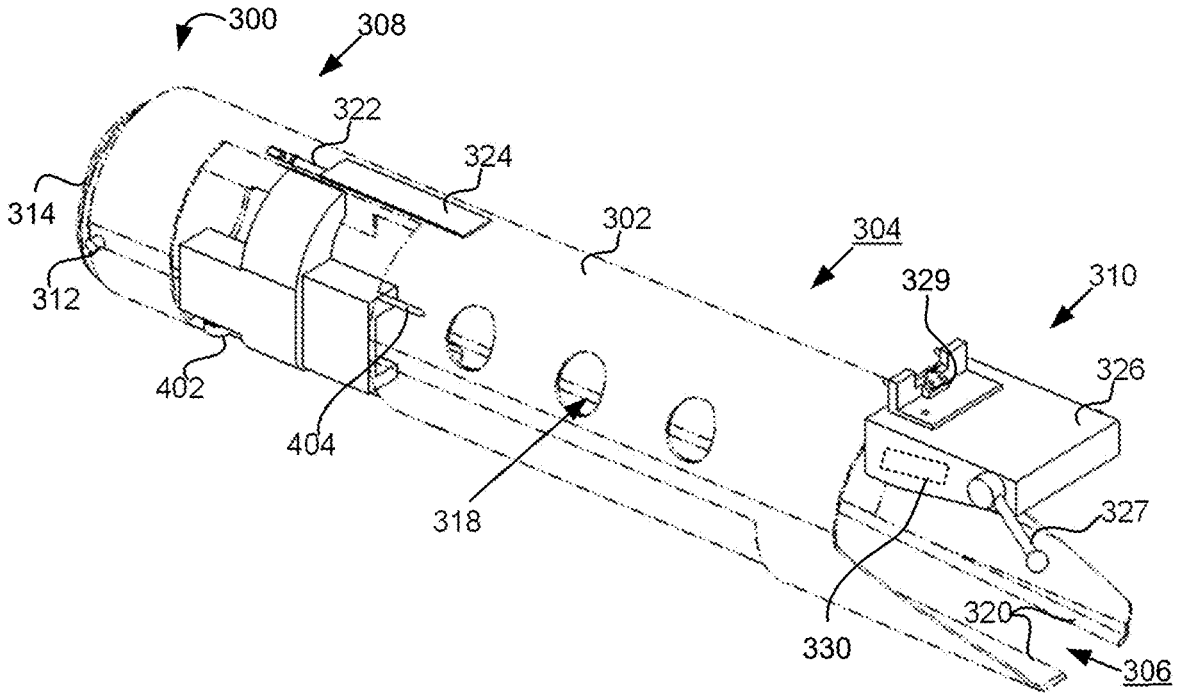
FIG. 4 is a rear perspective view of an embodiment of an adapter of the present disclosure.

FIG. 4 is a rear perspective view of an embodiment of an adapter of the present disclosure. Adapter 300 is configured to receive a missile therein. The adapter 300 includes a support member 302. The support member 302 is a substantially cylindrical support structure that surrounds and supports the missile when the missile is loaded into the adapter 300. In various embodiments, the support member 302 matches the dimensions and/or profile of a missile for which the launcher is designed to load and launch. For example, the launcher may be configured to receive a first missile. The adapter 300 enables the launcher to receive a second missile having different dimensions and/or profile. The support member 302 of the adapter 300 matches the dimensions and/or profile of the first missile to enable loading of the second missile into the launcher.

The support member 302 includes an internal surface 306 and an external surface 304, a fore portion 308, and an aft portion 310. The internal surface 306 and the external surface 304 each include features that enable a launcher to couple to the adapter 300 and features that enable the adapter 300 to couple to and receive a missile.

In various embodiments, the external surface 304 includes one or more guide pins 312 along the fore portion 308 configured to slide through one or more corresponding guide rails on a receiving dual column chassis of a launcher. The external surface 304 of the support member 302 includes a pilot feature 314 on the fore portion 308 that engages with the launcher. For example, an outer diameter of the pilot feature 314 is less than or equal to the inner diameter of a corresponding feature on a launcher such that a snug fit exists between the pilot feature 314 and the launcher for aligning the adapter 300 in the launcher (e.g., in one of the columns of the dual column chassis of the launcher). In some embodiments, the pilot feature 314 on the fore portion 308 of the adapter 300 facilitates centering the adapter 300 and aligning the adapter 300 in the launcher.

Visible in this view, the external surface 304 includes an electrical interface 402 configured to couple to the launcher. The electrical interface 402 may be part of a larger electrical mechanism having the function of a floating mechanism unit (FMU) that provides power and/or data between the launcher and the missile. The internal surface 306 includes an electrical interface guide pin 404 that further facilitates transfer of power and/or data between the launcher and the missile by ensuring proper alignment and complete seating of the mating connectors.

According to at least some embodiments, the support member 302 defines access cutouts 318 that enable access to the internal surface 306 of the support member 302. For example, access to the internal surface 306 may be desirable for installment of various components during manufacturing such as alignment pins, etc. The access cutouts 318 also act as lightweighting features for reducing the overall weight of the adapter 300 and/or a system including a launcher, the adapter, a missile, etc.

The internal surface 306 includes various features that enable the adapter 300 to receive a missile therein. Visible in this view, the internal surface 306 includes lower guide rails 320 that extend along a longitudinal length of the adapter 300 (e.g., of the support member 302 of the adapter 300). Lower guide rails 320 enable coarse alignment of the missile as the missile is loaded into the adapter 300. Lower guide rails 320 provide mechanical alignment for the missile. A fore alignment pin 322 provides a fine alignment of the missile as the missile is loaded into the adapter 300. For example, the fore alignment pin 322 is received in a corresponding aperture in the missile for aligning the missile in the adapter 300.

The internal surface 306 also includes a fore strike plate 324. The fore strike plate 324 acts as a wear surface on the internal surface 306. For example, the fore strike plate 324 reduces wear and breakdown of the internal surface 306 of the adapter 300 as missiles are loaded and launched in a manner that would be appreciated by one having ordinary skill in the art upon reading the present disclosure.

The support member 302 includes an aft mechanical stop feature 326. The aft mechanical stop feature 326 includes a locking pin system on the internal surface 306 of the support member 302. In at least some embodiments, the mechanical stop feature 326 is a handle locking mechanism 327 configured to engage the missile when the missile is loaded in the adapter 300. The internal surface 306 of the support member 302 may also include a second retention mechanism 330 configured to retain the aft portion 310 of the adapter 300 in the receiving column of the dual column chassis of the launcher. In various embodiments, the second retention mechanism 330 may include spring-loaded pins or other retaining mechanism for locking the adapter 300 within the launcher.

According to various embodiments, the mechanical stop feature 326 further includes a single swing-bolt style latch 329. The single swing-bolt style latch 329 may be interchangeably used with a double swing-bolt style latch 331 as shown in FIG. 14D according to any of the embodiments described herein.

Figure 5:
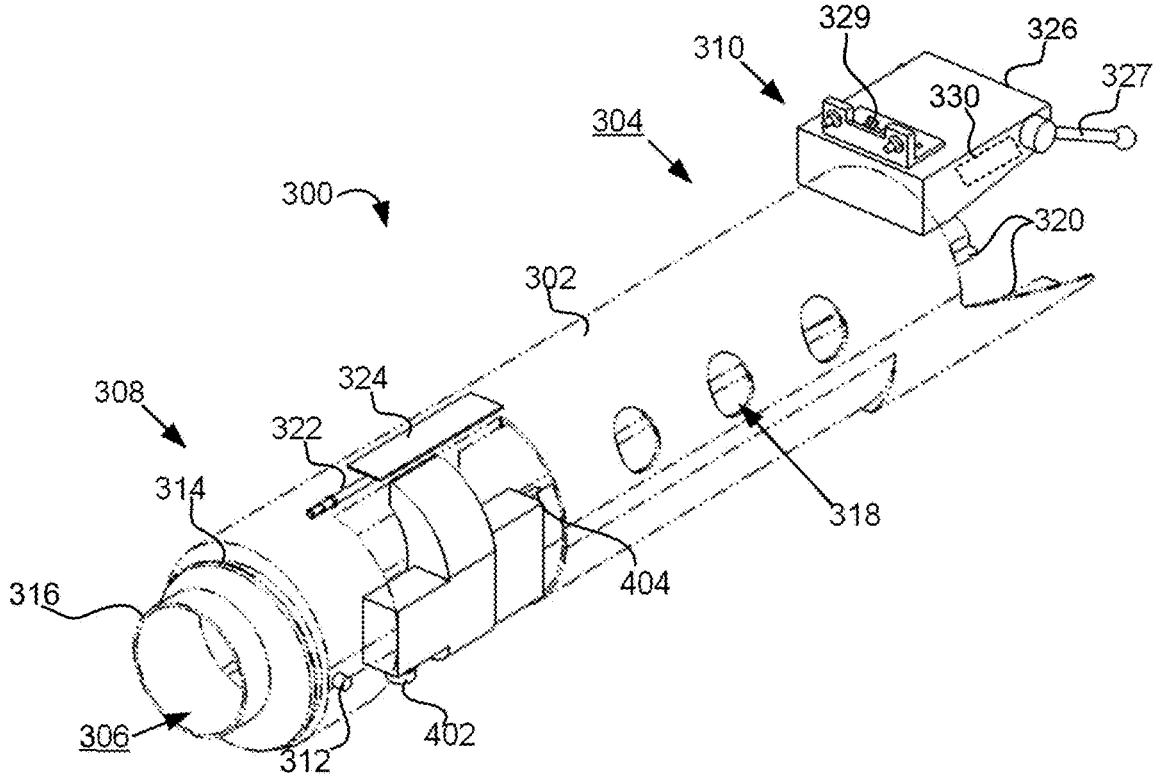
FIG. 5 is a front perspective view of an embodiment of an adapter of the present disclosure.
Figure 11:
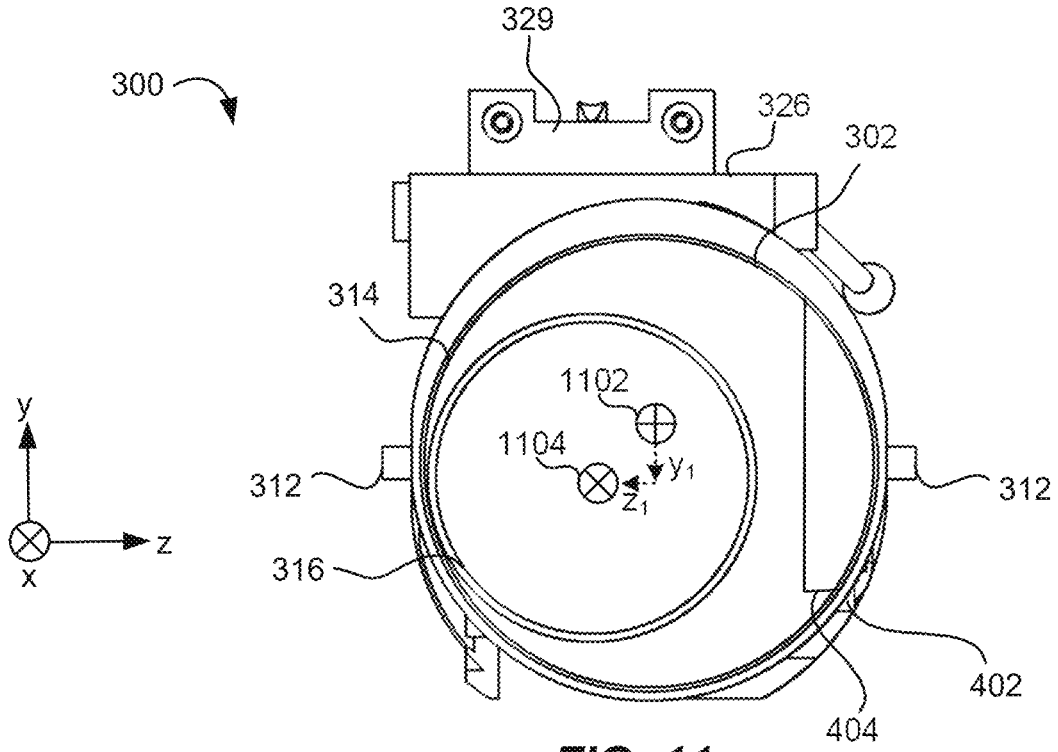
FIG. 11 is a front view of an embodiment of an adapter of the present disclosure.
Figure 12:
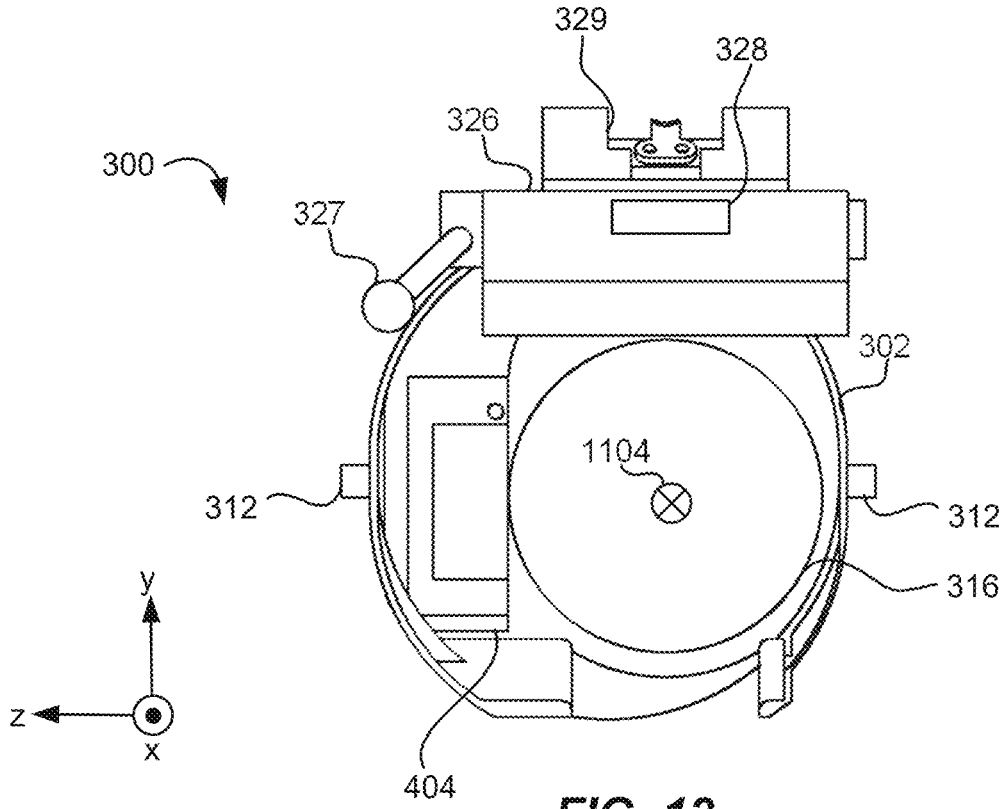
FIG. 12 is a rear view of an embodiment of an adapter of the present disclosure.

FIG. 5 is a front perspective view of an embodiment of an adapter of the present disclosure. The description of adapter 300 provided in relation to FIGS. 3 and 4 is applicable to the front perspective view of adapter 300 illustrated in FIG. 5 as appropriate. In particular, the description of the front perspective view of FIG. 3 is applicable to the front perspective view of FIG. 5. The extension portion 316 and the pilot feature 314 are laterally offset as shown by comparing FIGS. 3 and 5. For example, as visible in FIG. 3, the outer perimeters of the extension portion 316 and the pilot feature 314 are closer together than the outer perimeters of the extension portion 316 and the pilot feature 314 as visible in FIG. 5. Referring ahead to FIGS. 11 and 12, a central axis 1102 of the pilot feature 314 is laterally offset and transversely offset from a central axis 1104 of the extension portion 316 as shown in FIG. 11.

According to various embodiments, the mechanical stop feature 326 further includes a single swing-bolt style latch 329. The single swing-bolt style latch 329 may be interchangeably used with a double swing-bolt style latch 331 as shown in FIG. 14D according to any of the embodiments described herein.

Figure 6:
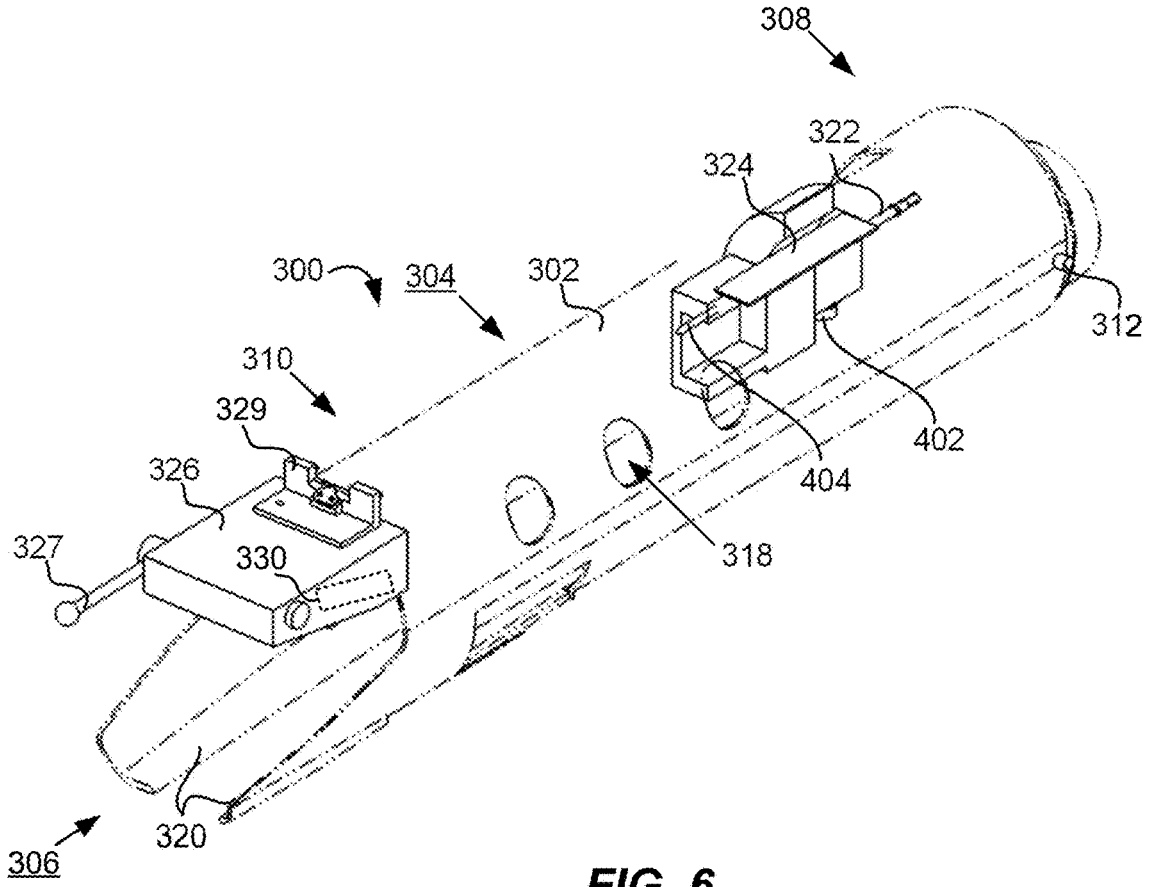
FIG. 6 is a rear perspective view of an embodiment of an adapter of the present disclosure.

FIG. 6 is a rear perspective view of an embodiment of an adapter of the present disclosure. The description of adapter 300 provided in relation to FIGS. 3-5 is applicable to the rear perspective view of adapter 300 illustrated in FIG. 6 as appropriate. In particular, the description of the rear perspective view of FIG. 4 is applicable to the rear perspective view of FIG. 6. Visible in this view, the internal surface 306 includes lower guide rails 320 along a longitudinal length of the adapter 300 (e.g., of the support member 302 of the adapter 300). Lower guide rails 320 enable coarse alignment of the missile as the missile is loaded into the adapter 300. As shown in FIG. 6, the lower guide rails 320 are substantially flat surfaces (in contrast to the generally cylindrical shape of the adapter 300) on which the missile slides toward the fore alignment pin 322 that provides a fine alignment of the missile as the missile is loaded into the adapter 300.

According to various embodiments, the mechanical stop feature 326 further includes a single swing-bolt style latch 329. The single swing-bolt style latch 329 may be interchangeably used with a double swing-bolt style latch 331 as shown in FIG. 14D according to any of the embodiments described herein.

Figure 7:
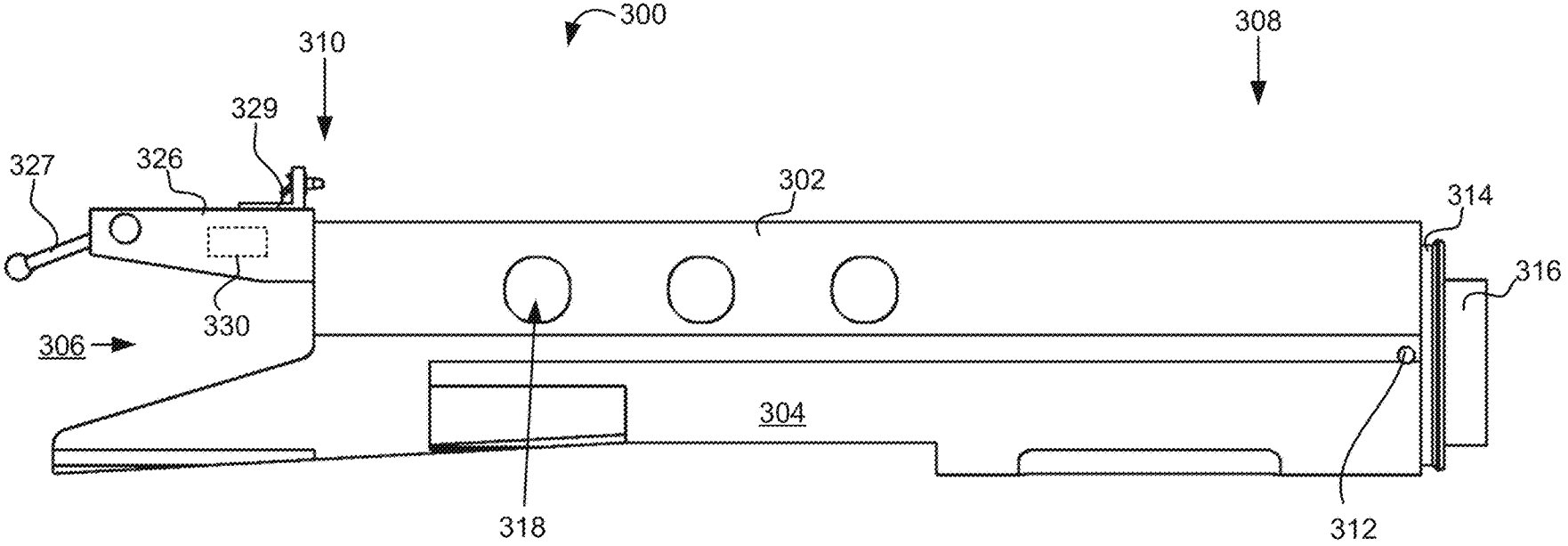
FIG. 7 is a side view of an embodiment of an adapter of the present disclosure.
Figure 13:
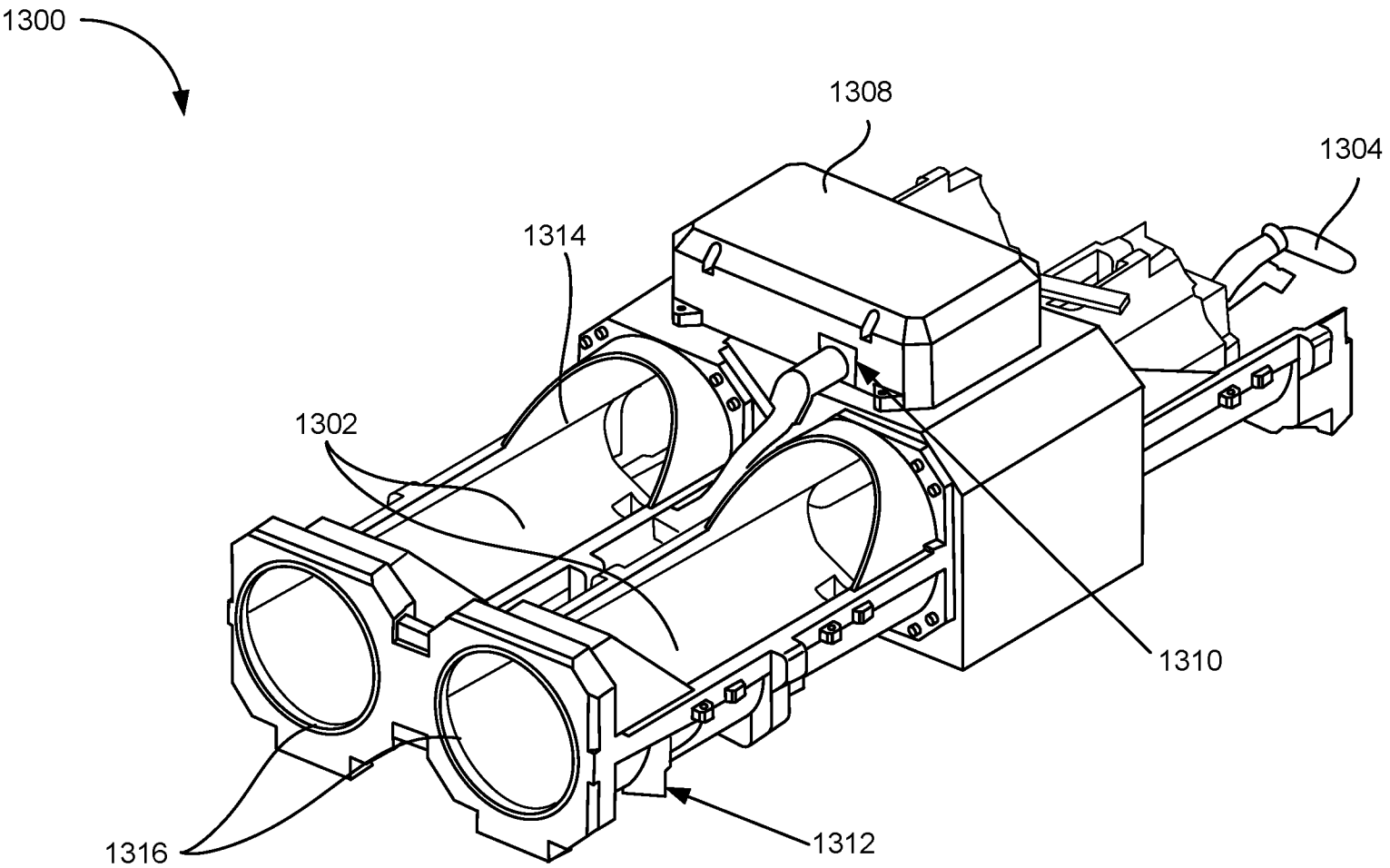
FIG. 13 is a front perspective view of an embodiment of a modified double chassis of the present disclosure.

FIG. 7 is a side view of an embodiment of an adapter of the present disclosure. The description of adapter 300 provided in relation to FIGS. 3-6 is applicable to the side view of adapter 300 illustrated in FIG. 7 as appropriate. Visible in this view, the external surface 304 includes the one or more guide pins 312 along the fore portion 308. Referring ahead to FIGS. 13 and 14, a launcher 1300 includes side guide rails 1314. One or more guide pins 312 may be received in and slide along the side guide rails 1314. The side guide rails 1314 guide the one or more guide pins 312 along a length of the support member 302. For example, one or more guide pins 312 correspond to side guide rails 1314 such that the adapter 300 is smoothly guided into the launcher and the extension portion 316 and the pilot feature 314 are directed toward pilot feature 1316 as shown in FIGS. 13 and 14A.

According to various embodiments, the mechanical stop feature 326 further includes a single swing-bolt style latch 329. The single swing-bolt style latch 329 may be interchangeably used with a double swing-bolt style latch 331 as shown in FIG. 14D according to any of the embodiments described herein.

Figure 8A:
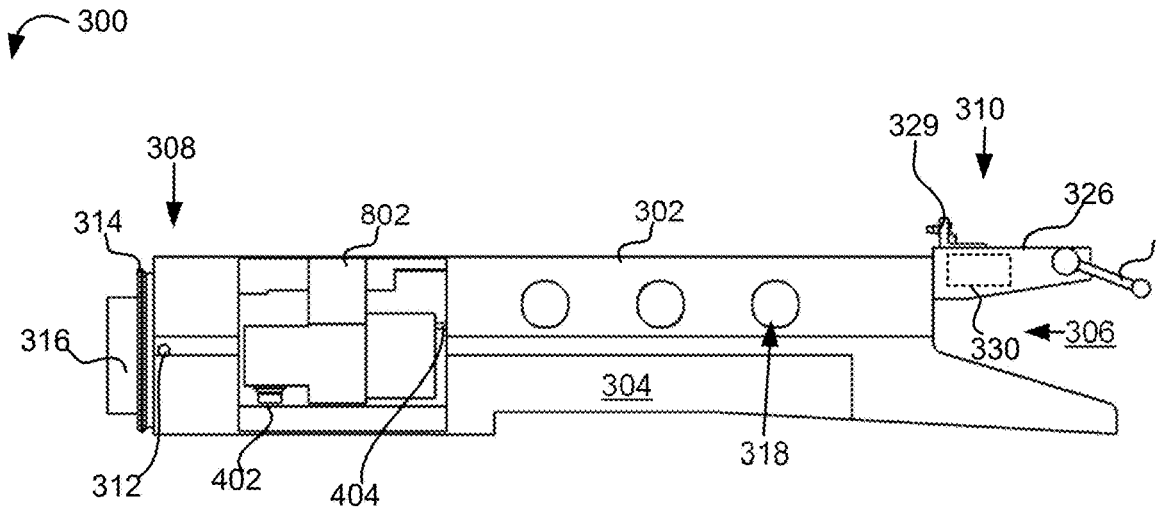
FIG. 8A is a side view of an embodiment of an adapter of the present disclosure.

FIG. 8A is a side view of an embodiment of an adapter of the present disclosure. The description of adapter 300 provided in relation to FIGS. 3-7 is applicable to the side view of adapter 300 illustrated in FIG. 8A as appropriate. As shown in more detail in FIG. 8A, the electrical interface 402 is a connector configured to couple to the launcher. In particular, referring ahead to FIGS. 13 and 14A, the electrical interface 402 is configured to couple to a second electrical interface 1312 of the launcher 1300 for transferring power and/or data between the power and control units on the interior of a vehicle via a separate cable and the adapter 300 and/or the missile. As shown in FIG. 8A, the electrical interface 402 is part of a larger electrical mechanism 802 having the function of a floating mechanism unit (FMU) that provides power and/or data between the launcher and the missile. Visible in this side view, an electrical interface guide pin 404 is configured to further facilitate transfer of power and/or data between the launcher and the missile. The electrical interface guide pin 404 may be received by a corresponding aperture in the missile, as would be appreciated by one having ordinary skill in the art.

According to various embodiments, the mechanical stop feature 326 further includes a single swing-bolt style latch 329. The single swing-bolt style latch 329 may be interchangeably used with a double swing-bolt style latch 331 as shown in FIG. 14D according to any of the embodiments described herein.

Figure 8B:
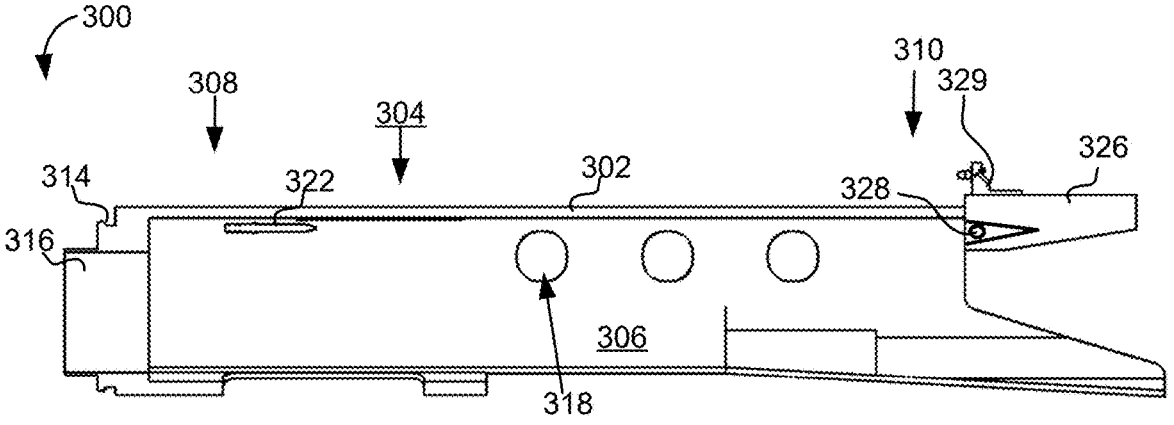
FIG. 8B is a cross-section of a side view of an embodiment of an adapter of the present disclosure.

FIG. 8B is a cross-section of a side view of an embodiment of an adapter of the present disclosure. The description of adapter 300 provided in relation to FIGS. 3-8A is applicable to the cross-section of a side view of adapter 300 illustrated in FIG. 8B as appropriate. As shown in more detail in FIG. 8B, the support member 302 includes a fore alignment pin 322 that provides a fine alignment of the missile as the missile is loaded into the adapter 300. For example, the fore alignment pin 322 is received in a corresponding aperture in the missile for aligning the missile in the adapter 300 as the missile is directed through the adapter 300.

As further shown in FIG. 8B, the support member 302 includes an aft mechanical stop feature 326. The aft mechanical stop feature 326 includes a locking pin system on the internal surface 306 of the support member 302. The aft mechanical stop feature 326 includes a first retention mechanism 328 that maintains the missile in the adapter 300. The first retention mechanism 328 is shown as a cross-pin that the mechanical stop feature 326 engages with when the handle portion of the mechanical stop feature 326 is in an engaged position.

According to various embodiments, the mechanical stop feature 326 further includes a single swing-bolt style latch 329. The single swing-bolt style latch 329 may be interchangeably used with a double swing-bolt style latch 331 as shown in FIG. 14D according to any of the embodiments described herein.

Figure 9:
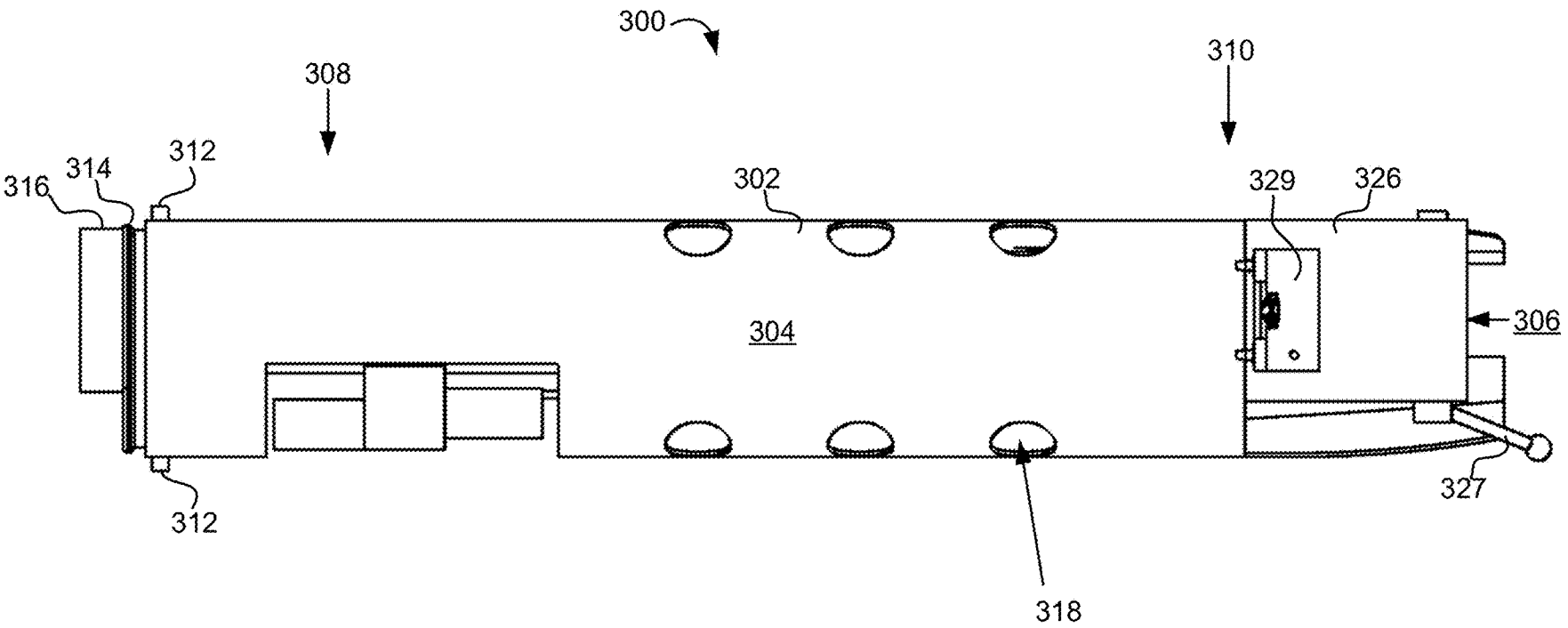
FIG. 9 is a top view of an embodiment of an adapter of the present disclosure.

FIG. 9 is a top view of an embodiment of an adapter of the present disclosure. The description of adapter 300 provided in relation to FIGS. 3-8B is applicable to the top view of adapter 300 illustrated in FIG. 9 as appropriate. As shown in more detail in the view of FIG. 9, the support member 302 includes one or more guide pins 312 on each side of the support member 302. Referring ahead to FIGS. 13 and 14A, the one or more guide pins 312 correspond to side guide rails 1314 of launcher 1300. One or more guide pins 312 may be received in and slide along the side guide rails 1314.

As shown in this top view, the extension portion 316 and the pilot feature 314 are laterally offset such that one side of the extension portion 316 is much closer to a corresponding side of the pilot feature 314 when compared to the opposite sides. For example, as shown in FIG. 9, the outer perimeters of the extension portion 316 and the pilot feature 314 are closer together on one side (e.g., toward one of the one or more guide pins 312) compared to the other side (e.g., toward another one of the one or more guide pins 312). Referring ahead to FIGS. 11 and 12, a central axis 1102 of the pilot feature 314 is laterally offset and transversely offset from a central axis 1104 of the extension portion 316 as shown in FIG. 11.

According to various embodiments, the mechanical stop feature 326 further includes a single swing-bolt style latch 329. The single swing-bolt style latch 329 may be interchangeably used with a double swing-bolt style latch 331 as shown in FIG. 14D according to any of the embodiments described herein.

Figure 10A:
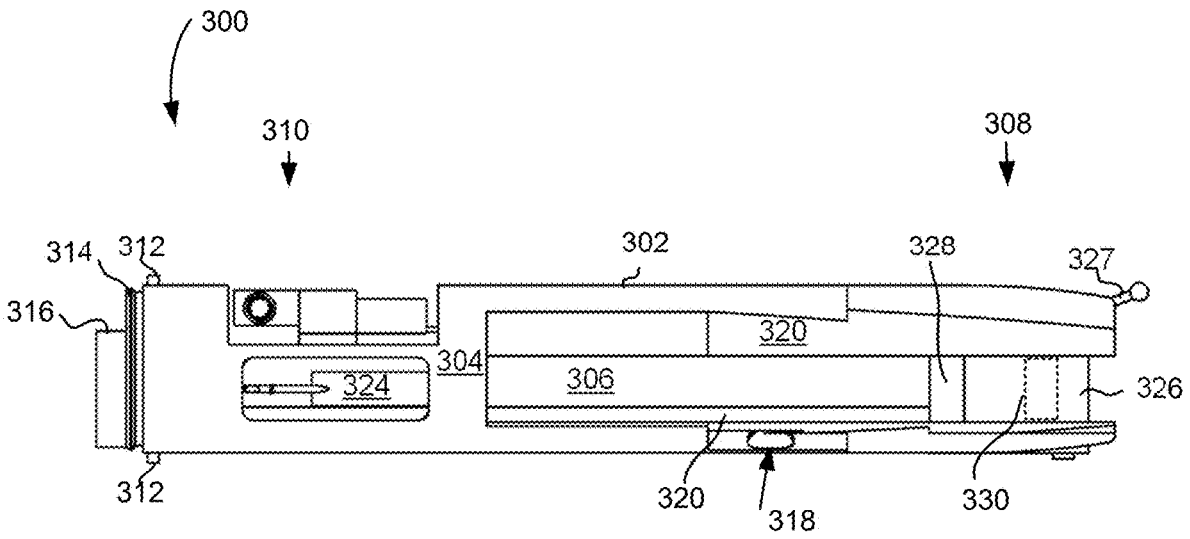
FIG. 10A is a bottom view of an embodiment of an adapter of the present disclosure.

FIG. 10A is a bottom view of an embodiment of an adapter of the present disclosure. The description of adapter 300 provided in relation to FIGS. 3-9 is applicable to the bottom view of adapter 300 illustrated in FIG. 10A as appropriate. As shown in more detail in the view of FIG. 10A, the support member 302 includes one or more guide pins 312 on each side of the support member 302. Referring ahead to FIGS. 13 and 14A, the one or more guide pins 312 correspond to side guide rails 1314 of launcher 1300. One or more guide pins 312 may be received in and slide along the side guide rails 1314.

As shown in this bottom view, the extension portion 316 and the pilot feature 314 are laterally offset such that one side of the extension portion 316 is much closer to a corresponding side of the pilot feature 314 when compared to the opposite sides. For example, as shown in FIG. 10A, the outer perimeters of the extension portion 316 and the pilot feature 314 are closer together on one side (e.g., toward one of the one or more guide pins 312) compared to the other side (e.g., toward another one of the one or more guide pins 312). Referring ahead to FIGS. 11 and 12, a central axis 1102 of the pilot feature 314 is offset both laterally and transversely from a central axis 1104 of the extension portion 316 as shown in FIG. 11.

Figure 10B:
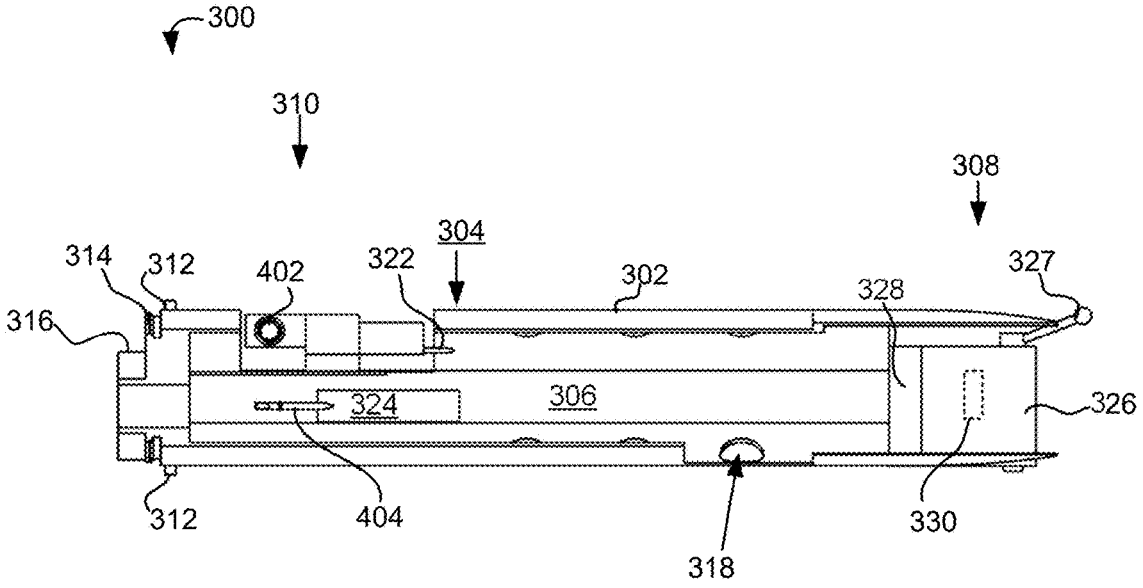
FIG. 10B is a cross-section of a bottom view of an embodiment of an adapter of the present disclosure.

FIG. 10B is a cross-section of a bottom view of an embodiment of an adapter of the present disclosure. The description of adapter 300 provided in relation to FIGS. 3-10A is applicable to the cross-section of a bottom view of adapter 300 illustrated in FIG. 10B as appropriate. As shown in this cross-sectional view of the bottom of the support member 302, the support member 302 includes an aft mechanical stop feature 326. The aft mechanical stop feature 326 includes a locking pin system on the internal surface 306 of the support member 302. The aft mechanical stop feature 326 includes a first retention mechanism 328 that maintains the missile in the adapter 300. The first retention mechanism 328 is shown as a cross-pin that the mechanical stop feature 326 engages with when the handle portion of the mechanical stop feature 326 is in an engaged position. The first retention mechanism 328 cross-pin spans the width of the aft mechanical stop feature 326.

FIG. 11 is a front view of an embodiment of an adapter of the present disclosure. The description of adapter 300 provided in relation to FIGS. 3-10B is applicable to the front view of adapter 300 illustrated in FIG. 11 as appropriate. As shown in more detail in FIG. 11, a central axis 1102 of the pilot feature 314 is offset both laterally and transversely from a central axis 1104 of the extension portion 316. For example, the central axis 1104 is shown as laterally offset along a z-axis by a distance $z_1$ from the central axis 1102 and transversely offset along a y-axis by a distance $y_1$ from the central axis 1102. Similarly, the central axis 1102 is shown as laterally offset along a z-axis by a distance $z_1$ from central axis 1104 and transversely offset from central axis 1104 along a y-axis by a distance $y_1$. In other words, the central axis 1102 of the pilot feature 314 is not aligned with the central axis 1104 of the extension portion 316. The pilot feature 314 engages with the launcher and the extension portion 316 engages with the missile. Because the missile is an alternative type of missile other than the type of missile for which the launcher was designed, the central axis 1104 of the extension portion 316 of the adapter 300 is laterally offset and transversely offset from the central axis 1102 of the pilot feature 314 to enable the launcher to use the alternative type of missile when loaded into an adapter such as adapter 300.

According to various embodiments, the mechanical stop feature 326 further includes a single swing-bolt style latch 329. The single swing-bolt style latch 329 may be interchangeably used with a double swing-bolt style latch 331 as shown in FIG. 14D according to any of the embodiments described herein.

FIG. 12 is a rear view of an embodiment of an adapter of the present disclosure. The description of adapter 300 provided in relation to FIGS. 3-11 is applicable to the rear view of adapter 300 illustrated in FIG. 12 as appropriate. From this perspective, the central axis 1104 of the extension portion 316 is shown relative to the support member 302. The pilot feature 314 (not shown) substantially defines the outer perimeter of the cylindrical shape of the support member 302. Accordingly, the central axis 1104 of the extension portion 316 appears to be offset from a center of the support member 302.

Advantageously, the adapter 300 as described herein does not inhibit performance capabilities of either the first missile or the second missile or the launcher. According to at least some embodiments, the adapter 300 may be stowed, with or without a second missile installed, in existing first missile racks. The adapter 300 as described herein adds minimal weight to existing configuration of the launcher and the first missile. The loading procedures are not substantially changed for the first missile loaded into the launcher or for the second missile loaded into the adapter loaded into the launcher. A further benefit of the adapter 300 as disclosed herein is that no additional tools are needed to change the launcher from the first missile configuration to the adapter/second missile configuration and vice versa.

According to various embodiments, the mechanical stop feature 326 further includes a single swing-bolt style latch 329. The single swing-bolt style latch 329 may be interchangeably used with a double swing-bolt style latch 331 as shown in FIG. 14D according to any of the embodiments described herein.

FIG. 13 is a front perspective view of an embodiment of a modified double chassis of the present disclosure. Launcher 1300 includes a dual column chassis. According to at least some embodiments, the launcher 1300 is a modified UTML. The launcher 1300 is configured to receive a first missile (e.g., a first type of missile) in each column 1302. The first missile may be an existing TOW missile configured for use with a UTML launcher. Each column 1302 is configured to receive an adapter, such as adapter 300 described with respect to FIGS. 3-12 above. Each adapter is configured to receive a second missile (e.g., a second type of missile) such as a Spike LR2 missile, in accordance with at least some embodiments of the present disclosure. An adapter may be inserted into each column 1302 of the launcher 1300 and each missile is independently insertable into each adapter. In at least some embodiments, each column 1302 of the launcher 1300 may include additional cutouts (not shown) to accommodate the adapter and/or the second missile.

In at least some configurations, the launcher 1300 transitions from a first missile configuration to a second missile configuration to receive the adapter. For example, in some embodiments, a retainer component 1304 of the launcher 1300 may be pulled backward and downward (as shown in FIG. 13). The launcher 1300 is configured to receive the first missile in the first missile configuration and the launcher 1300 is configured to receive the second missile in the second missile configuration (as shown in FIG. 13).

The launcher 1300 may also include an armament control unit (ACU) 1308 that actuates the electrical connectors into and out of the first missiles as well as provides fire control commands to each of the two first missile types when installed. The launcher 1300 includes a first electrical interface 1310 for transferring power and/or data between the ACU 1308 of the launcher 1300 and power and control units on the interior of a vehicle via a separate cable. The ACU 1308 then provides the electrical connection into the first missile via connectors protruding from the base of the ACU into the first missile canister. The launcher 1300 further includes a second electrical interface 1312 for transferring power and/or data between power and control units on the interior of a vehicle via a separate cable and the second missile and/or the adapter, such as adapter 300 described with respect to FIGS. 3-12 above. For example, the second electrical interface 1312 of the launcher 1300 is configured to couple to the electrical interface 402 as described at least with respect to FIG. 4.

Launcher 1300 includes side guide rails 1314. Side guide rails 1314 are configured to receive guide pins, such as guide pins 312 of adapter 300 described in FIGS. 3-12 above, to guide an adapter through a column 1302. Launcher 1300 also include a pilot feature 1316 that is configured to couple with a pilot feature of an adapter, such as pilot feature 314 of adapter 300 described in FIGS. 3-12 above. For example, an outer diameter of the pilot feature of the adapter is less than or equal to the inner diameter of the pilot feature 1316 of the launcher 1300 such that a snug fit exists between the pilot feature of the adapter and the pilot feature 1316 of the launcher 1300 for aligning the adapter in the launcher 1300 (e.g., in the column 1302 of the dual column chassis of the launcher 1300).

FIG. 14A is a rear perspective view of an embodiment of a modified double chassis of the present disclosure. The description of launcher 1300 provided in relation to FIG. 13 is applicable to the rear perspective view of launcher 1300 illustrated in FIG. 14A as appropriate. Visible in this view, the launcher 1300 includes one or more aft capture features 1402. The one or more aft capture features 1402 are configured to retain the first missile and/or the adapter within each column 1302 of the launcher 1300.

Figure 14B:
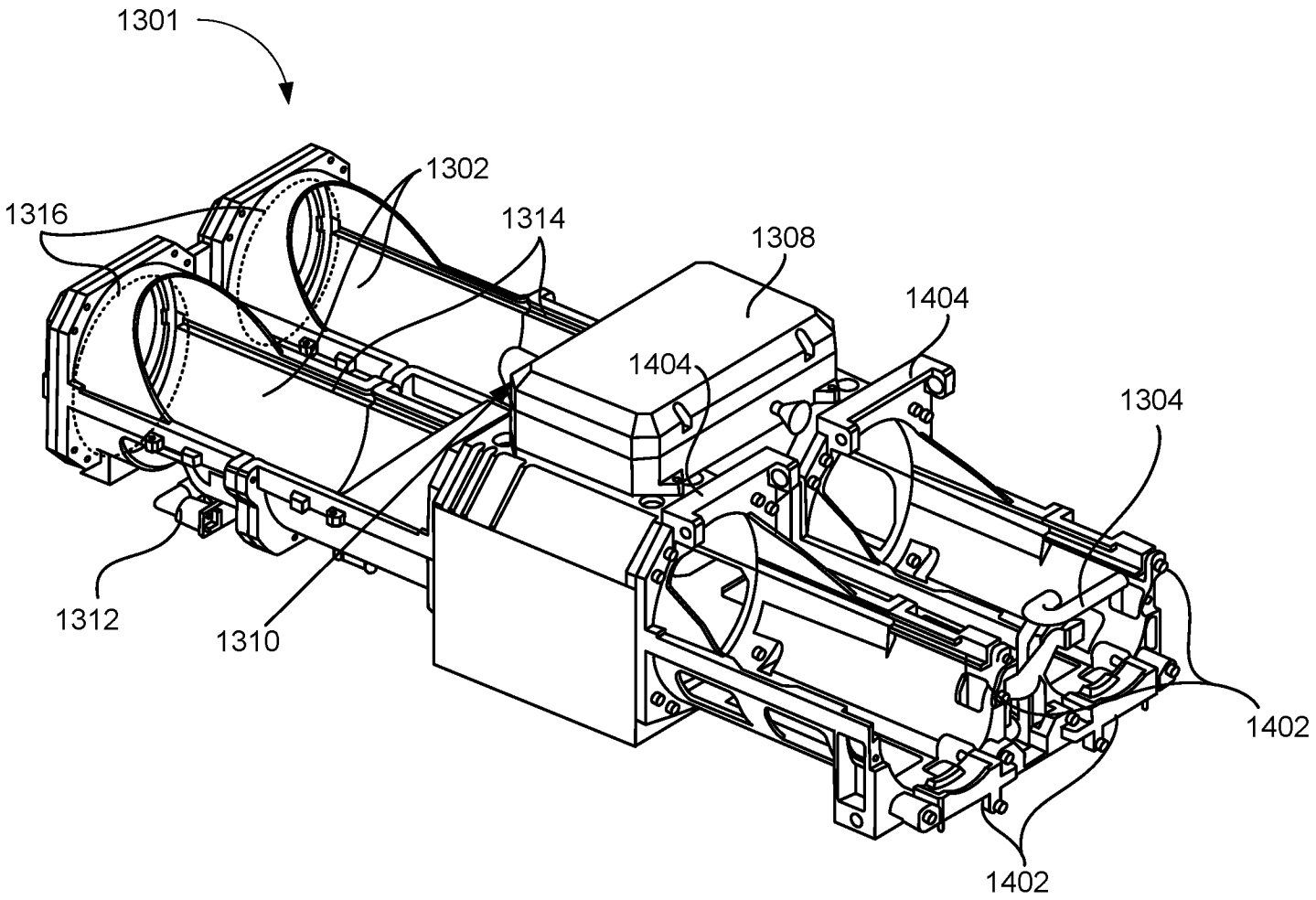
FIG. 14B is a rear perspective view of an alternative modified double chassis according to an embodiment of the present disclosure.

FIG. 14B is a rear perspective view of an alternative modified double chassis according to an embodiment of the present disclosure. The description of launcher 1300 provided in relation to FIGS. 13-14A is applicable to the rear perspective view of an alternative embodiment of a modified double chassis, as appropriate. Visible in this view, an aft bracket guide 1404 is provided for each column 1302 of the launcher 1301. Each aft bracket guide 1404 may be a U-shaped structure having two extensions forming the U-shape and an aperture through each extension of the U-shape. Each aft bracket guide 1404 is configured to receive corresponding pins 1410 of a spring-loaded pin retention mechanism 1406 on an adapter 1400 illustrated in FIG. 14C, to be described in further detail below with respect to FIGS. 14C-14G. Each aft bracket guide 1404 retains an adapter 1400 in the launcher 1301, for example, during launching, loading, or unloading of a missile (e.g., such as missile 130 described with respect to FIG. 1) or a missile canister from the launcher 1301. The retainer component 1304 of the launcher 1301 may be pulled backward and downward from the position shown in FIG. 14B to eject a missile from the launcher 1301 while an adapter 1400 remains retained within the launcher 1301 by the aft bracket guide 1404.

Figure 14C:
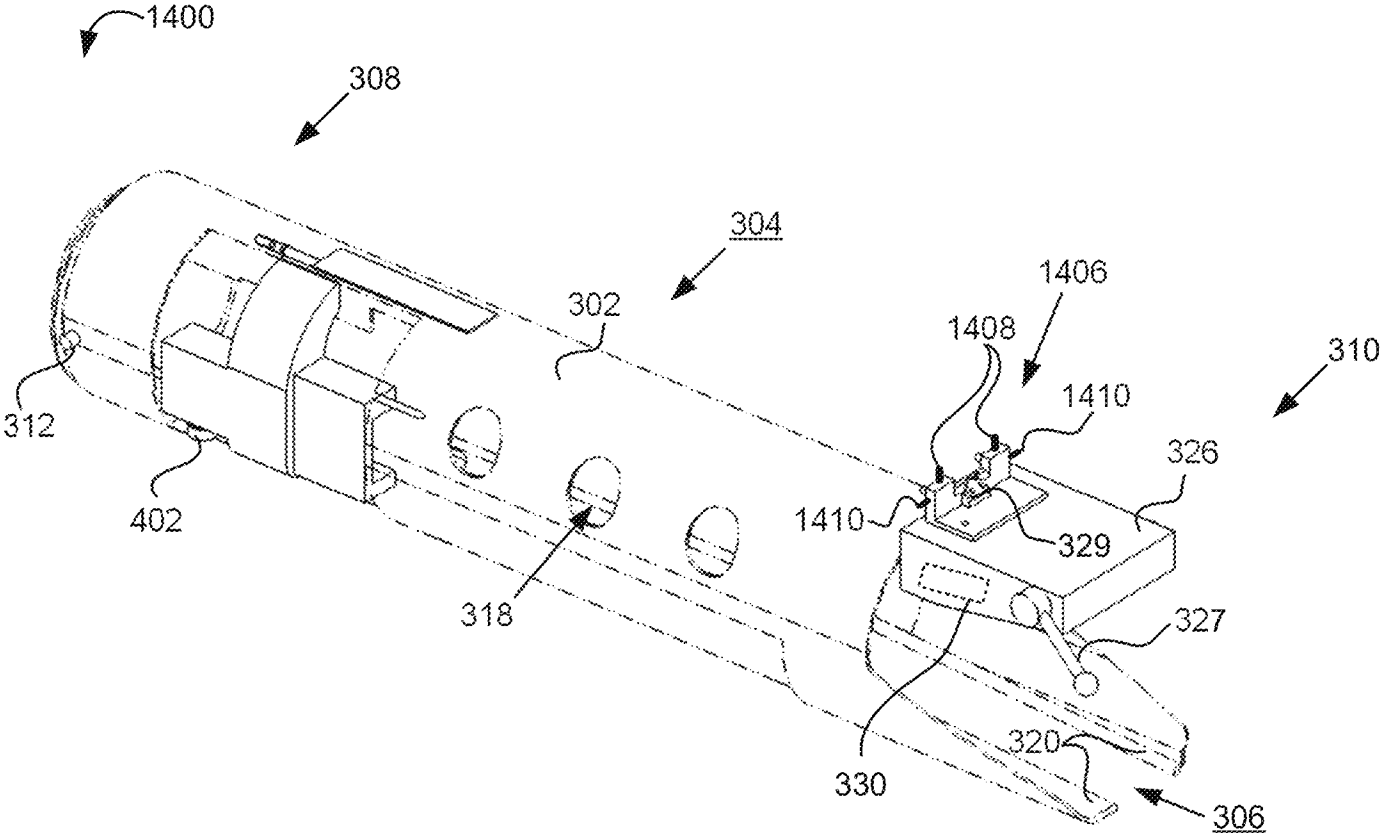
FIG. 14C is a rear perspective view of an alternative adapter according to an embodiment of the present disclosure.
Figure 14D:
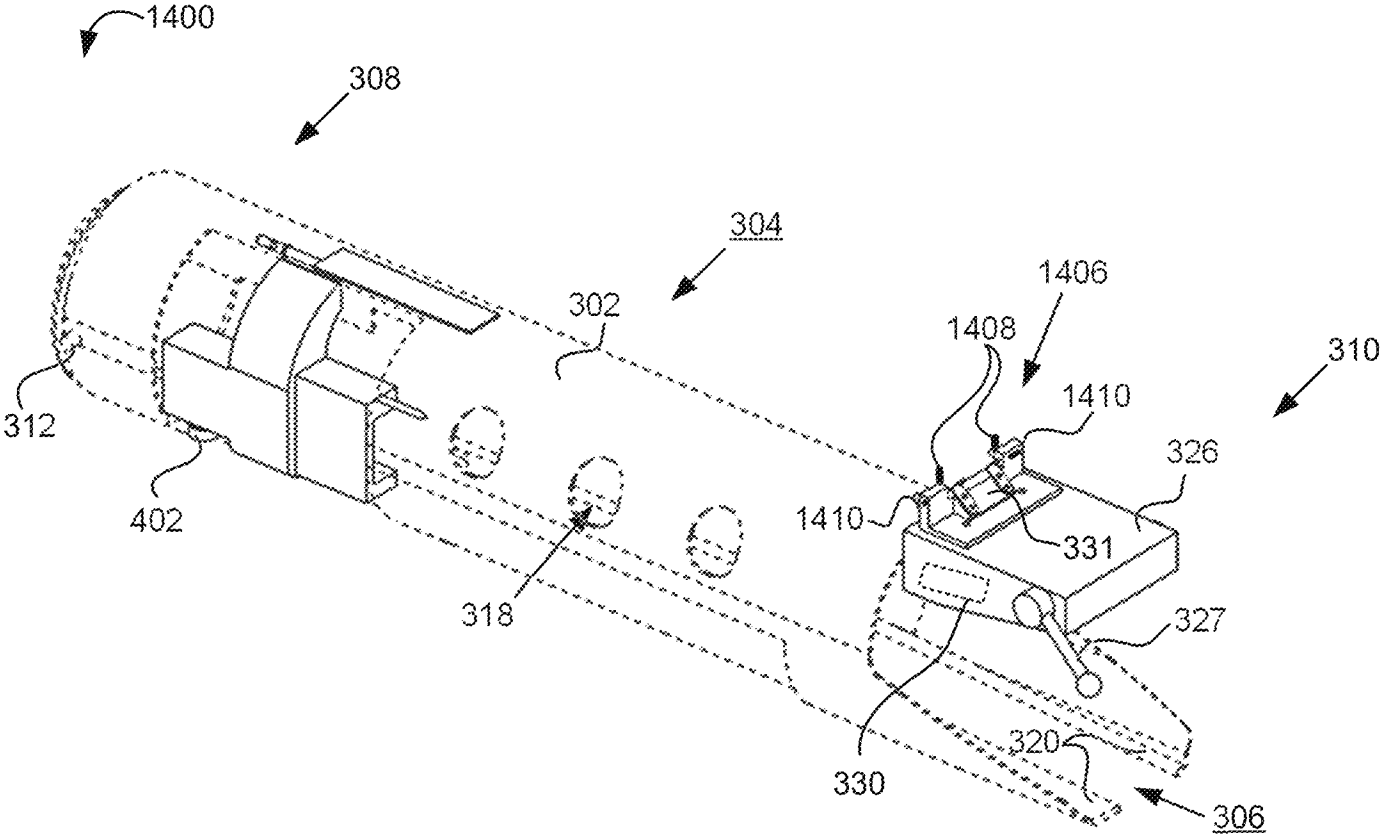
FIG. 14D is a rear perspective view of an alternative adapter according to an embodiment of the present disclosure.

FIG. 14C is a rear perspective view of an alternative adapter according to an embodiment of the present disclosure. The description of adapter 300 provided in relation to FIGS. 3-12 and the description of launcher 1300 and launcher 1301 illustrated in FIGS. 13-14B is applicable to the alternative embodiment of the adapter as appropriate. Visible in this view, an adapter 1400 may include a spring-loaded pin retention mechanism 1406 for coupling to an aft bracket guide 1404 of launcher 1301 illustrated in FIG. 14B. The spring-loaded pin retention mechanism 1406 includes at least two projections 1408 that, when brought together, retract pins 1410 into the spring-loaded pin retention mechanism 1406. The at least two projections 1408 and the pins 1410 are spring-loaded such that, when the at least two projections 1408 are released, the pins 1410 extend from the spring-loaded pin retention mechanism 1406, in a manner that would be appreciated by one having ordinary skill in the art in view of the present disclosure. Each of the pins 1410 corresponds to an aperture of an extension of an aft bracket guide 1404. The pins 1410 are retained within each aperture of the aft bracket guide 1404 to retain the adapter 1400 in the launcher 1301. To release the adapter 1400 from the launcher 1301, the at least two projections 1408 are brought together and the pins 1410 retract into the spring-loaded pin retention mechanism 1406 such that the adapter 1400 may be slid out of the launcher 1301.

According to various embodiments, the mechanical stop feature 326 further includes a single swing-bolt style latch 329. The single swing-bolt style latch 329 may be interchangeably used with a double swing-bolt style latch 331 as shown in FIG. 14D according to any of the embodiments described herein.

FIG. 14D is a rear perspective view of an alternative adapter according to an embodiment of the present disclosure. The description of adapter 300 provided in relation to FIGS. 3-12 and the description of launcher 1300 and launcher 1301 illustrated in FIGS. 13-14B is applicable to the alternative embodiment of the adapter as appropriate. Visible in this view, an adapter 1400 may include a spring-loaded pin retention mechanism 1406 for coupling to an aft bracket guide 1404 of launcher 1301 illustrated in FIG. 14B. The spring-loaded pin retention mechanism 1406 includes at least two projections 1408 that, when brought together, retract pins 1410 into the spring-loaded pin retention mechanism 1406. The at least two projections 1408 and the pins 1410 are spring-loaded such that, when the at least two projections 1408 are released, the pins 1410 extend from the spring-loaded pin retention mechanism 1406, in a manner that would be appreciated by one having ordinary skill in the art in view of the present disclosure. Each of the pins 1410 corresponds to an aperture of an extension of an aft bracket guide 1404. The pins 1410 are retained within each aperture of the aft bracket guide 1404 to retain the adapter 1400 in the launcher 1301 illustrated in FIG. 14B. To release the adapter 1400 from the launcher 1301, the at least two projections 1408 are brought together and the pins 1410 retract into the spring-loaded pin retention mechanism 1406 such that the adapter 1400 may be slid out of the launcher 1301. According to various embodiments, the mechanical stop feature 326 further includes a double swing-bolt style latch 331.

Figure 14E:
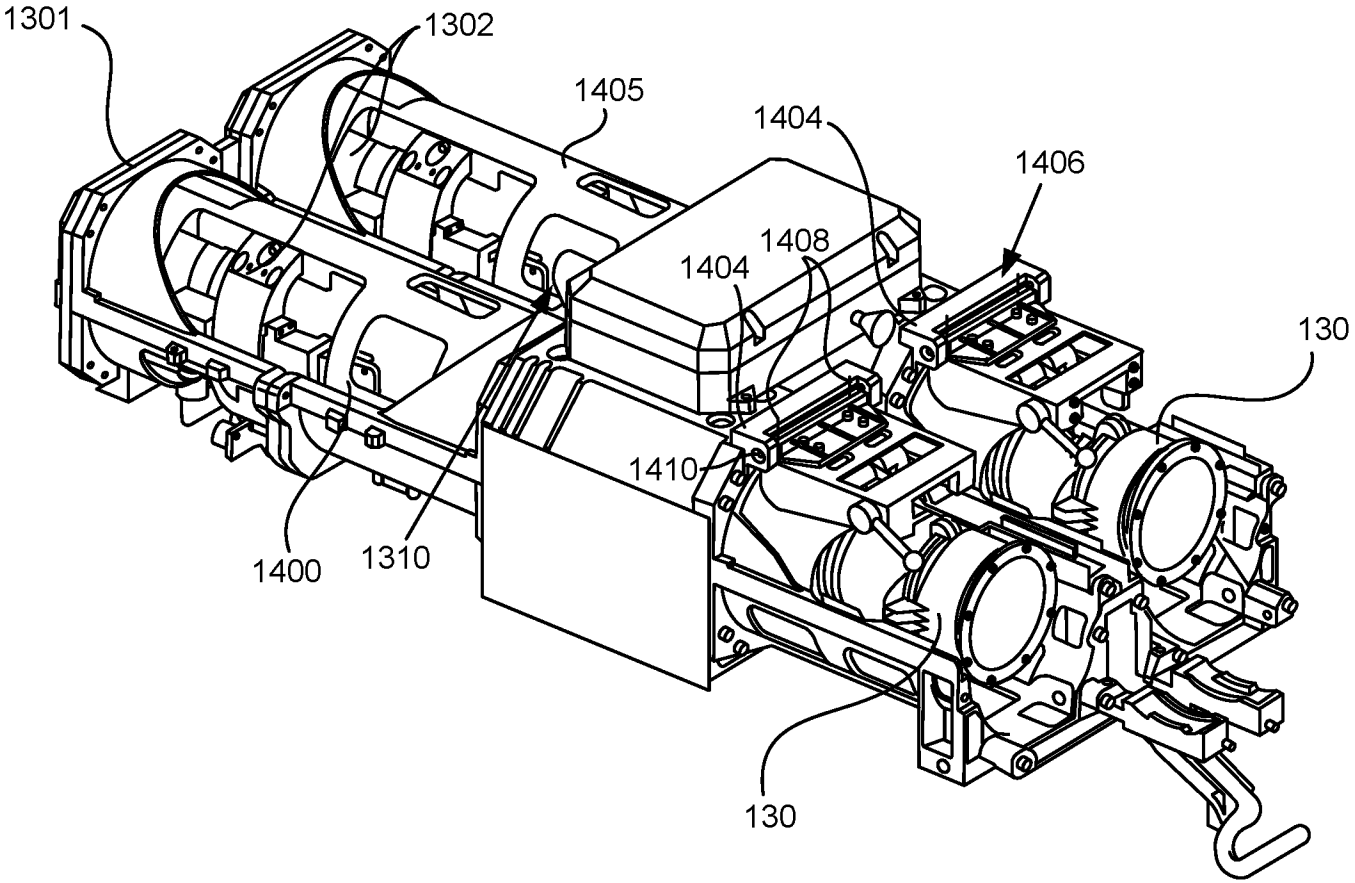
FIG. 14E is a rear perspective view of an alternative modified double chassis having an adapter disposed therein according to an embodiment of the present disclosure.

FIG. 14E is a rear perspective view of an alternative modified double chassis having an adapter disposed therein according to an embodiment of the present disclosure. The description of adapter 300 provided in relation to FIGS. 3-12 and the description of launcher 1300 and launcher 1301 illustrated in FIGS. 13-14B is applicable to the modified double chassis having an adapter as appropriate. In this view, a missile 130 as described with respect to FIG. 1 and other figures is loaded into an adapter 1405 that is retained within a launcher 1301. Each adapter 1405 is retained within the launcher 1301 using an aft bracket guide 1404 on each column 1302. A spring-loaded pin retention mechanism 1406 on each adapter 1405 is coupled to a corresponding aft bracket guide 1404 where the pins 1410 are expanded from the spring-loaded pin retention mechanism 1406 into an aperture of a corresponding aft bracket guide 1404. Again, to release the adapter 1405 from the launcher 1301, the at least two projections 1408 are brought together and the pins 1410 retract into the spring-loaded pin retention mechanism 1406, away from the aft bracket guide 1404, such that the adapter 1405 may be slid out of the launcher 1301.

Figure 14F:
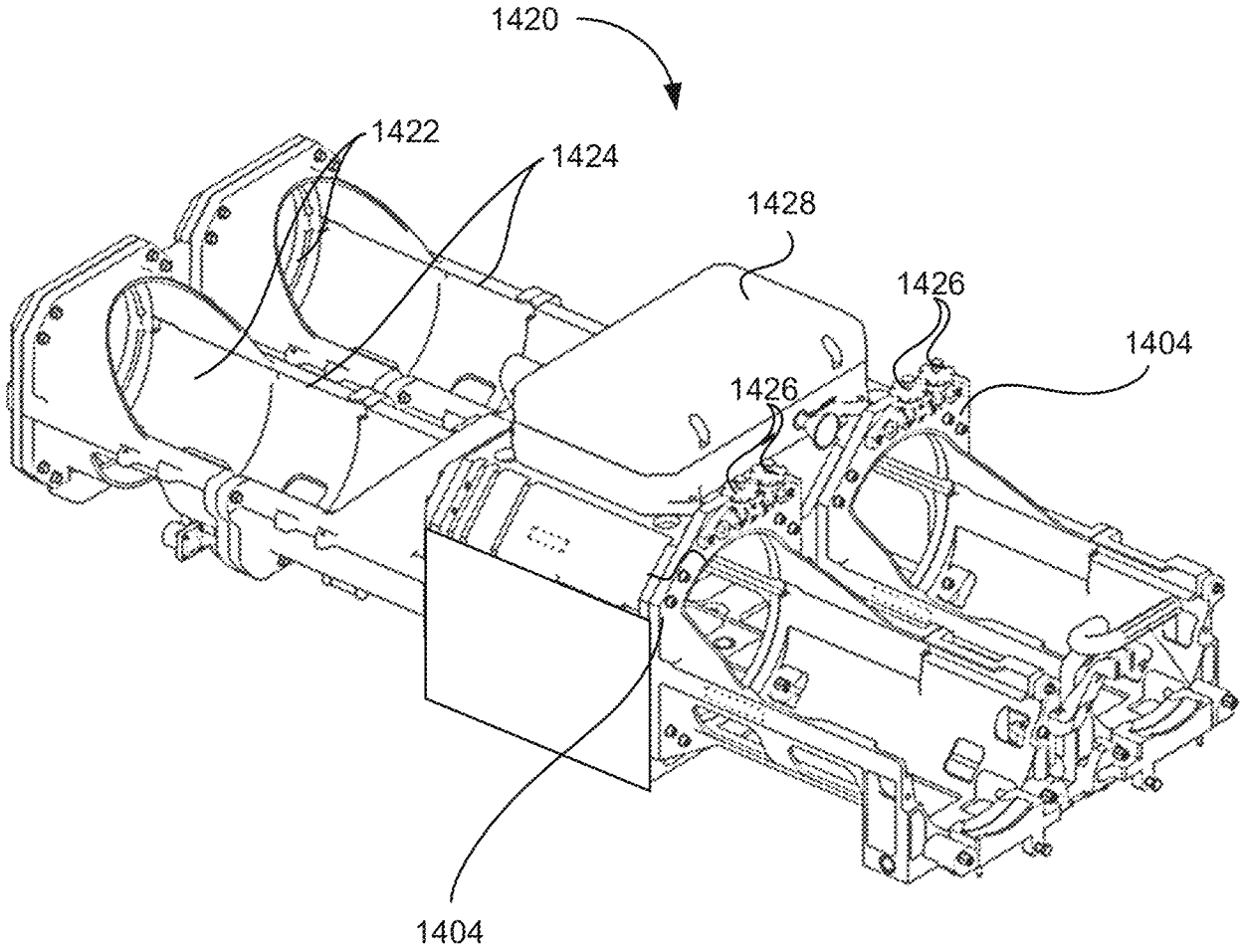
FIG. 14F is a rear perspective view of an alternative modified double chassis according to an embodiment of the present disclosure.

FIG. 14F is a rear perspective view of an alternative modified double chassis according to an embodiment of the present disclosure. The description of launcher 1300 and launcher 1301 illustrated in FIGS. 13-14B is applicable to the modified double chassis having an adapter as appropriate. Launcher 1420 includes a dual column chassis. According to at least some embodiments, the launcher 1420 is a modified UTML. The launcher 1420 is configured to receive a first missile (e.g., a first type of missile) in each column 1422. The first missile may be an existing TOW missile configured for use with a UTML launcher. Each column 1422 is configured to receive an adapter, such as adapter 300 described with respect to FIGS. 3-12 above. Each adapter is configured to receive a second missile (e.g., a second type of missile) such as a Spike LR2 missile, in accordance with at least some embodiments of the present disclosure. An adapter may be inserted into each column 1422 of the launcher 1420 and each missile is independently insertable into each adapter. In at least some embodiments, each column 1422 of the launcher 1420 may include additional cutouts (not shown) to accommodate the adapter and/or the second missile. The launcher 1420 may also include an armament control unit (ACU) 1428 that actuates the electrical connectors into and out of the first missiles as well as provides fire control commands to each of the two first missile types when installed. Launcher 1420 includes side guide rails 1424. Side guide rails 1424 are configured to receive guide pins, such as guide pins 312 of adapter 300 described in FIGS. 3-12 above, to guide an adapter through a column 1422. Launcher 1420 further includes knobs 1426 in the stowed position. The knobs 1426 are configured to secure an adapter within the column 1422.

Figure 14G:
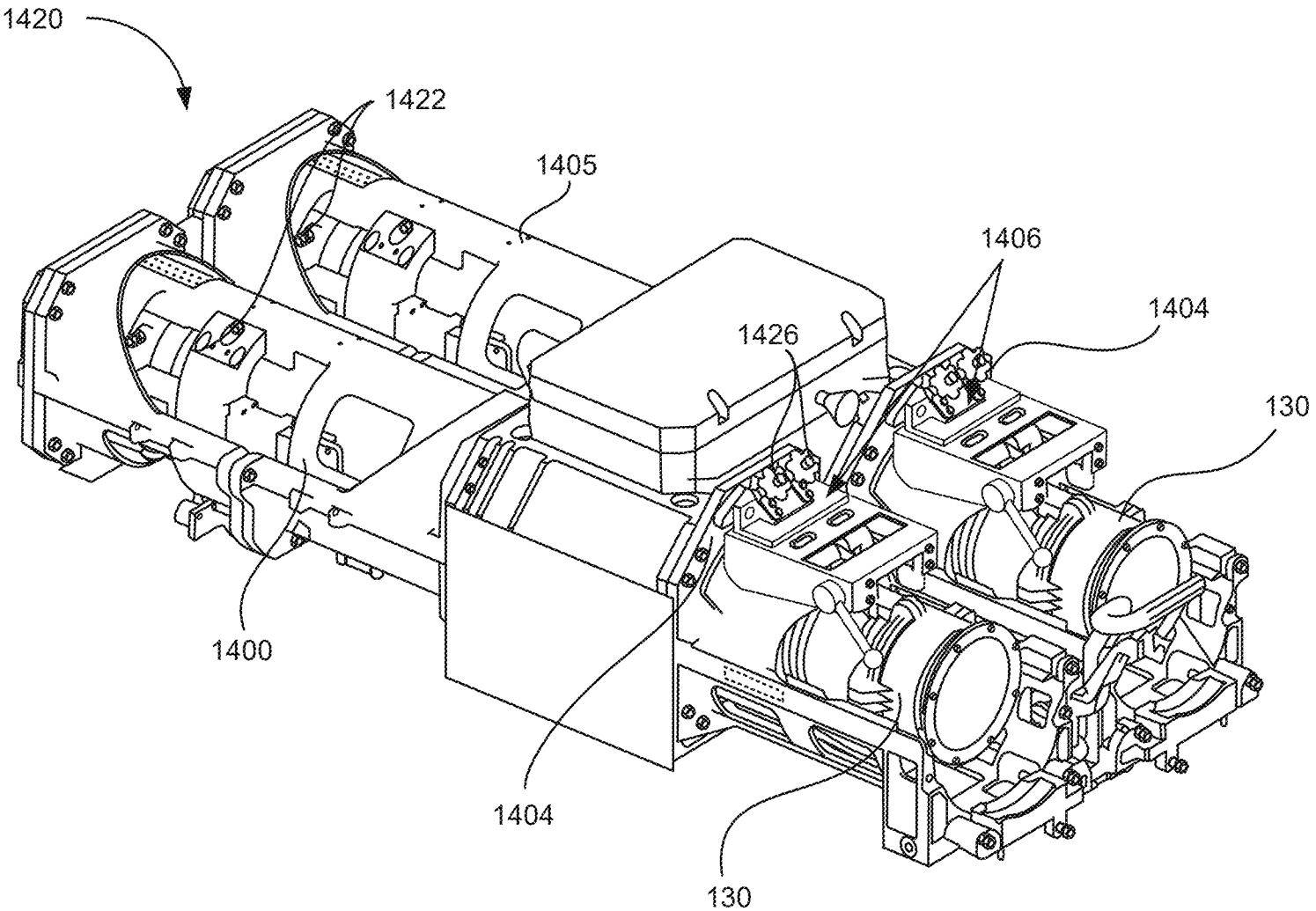
FIG. 14G is a rear perspective view of an alternative modified double chassis having an adapter disposed therein according to an embodiment of the present disclosure.

FIG. 14G is a rear perspective view of an alternative modified double chassis having an adapter disposed therein according to an embodiment of the present disclosure. The description of adapter 300 provided in relation to FIGS. 3-12 and the description of launcher 1300 and launcher 1301 illustrated in FIGS. 13-14B is applicable to the modified double chassis having an adapter as appropriate. In this view, a missile 130 as described with respect to FIG. 1 and other figures is loaded into an adapter 1405 that is retained within a launcher 1420. Each adapter 1405 is retained within the launcher 1420 using an aft bracket guide 1404 on each column 1422. A spring-loaded pin retention mechanism 1406 on each adapter 1400 is coupled to a corresponding aft bracket guide 1404 where the knobs 1426 are pulled up and rotated to loosen and free the knobs 1426 from the stowed position as shown in FIG. 14F. The knobs are swung downward and rotated (e.g., the opposite direction) to secure the adapter 1400 into the column 1422 of the launcher 1420.

Various examples of the present disclosure are provided below. As used below, any reference to a series of examples is to be understood as a reference to each of those examples disjunctively (e.g., "Examples 1-4" is to be understood as "Examples 1, 2, 3, or 4").

Example 1 is an adapter configured to receive a missile therein, the adapter comprising: a support member comprising an internal surface, an external surface, a fore portion, and an aft portion, wherein the external surface comprises: one or more guide pins along the fore portion configured to slide through one or more corresponding guide rails on a receiving dual column chassis of a launcher; a pilot feature on the fore portion engages with the launcher; an extension portion; an electrical interface configured to couple to the launcher; and a second retention mechanism configured to retain the aft portion of the adapter in the receiving dual column chassis; wherein the internal surface comprises: lower guide rails; a fore alignment pin; a fore strike plate; an electrical interface guide pin; a first retention mechanism; and an aft mechanical stop feature configured to engage the first retention mechanism.

Example 2 is the adapter of example 1, wherein the support member defines access cutouts that enable access to the internal surface of the support member.

Example 3 is the adapter of example(s) 1-2, wherein the aft mechanical stop feature is a handle locking mechanism configured to engage with the missile.

Example 4 is the adapter of example(s) 1-3, wherein a central axis of the pilot feature is laterally offset and transversely offset from a central axis of the support member.

Example 5 is the adapter of example(s) 1-4, wherein the missile is a Spike Long Range 2 (LR2) missile.

Example 6 is the adapter of example(s) 1-5, wherein the launcher is a modified Upgraded Tube-Launched, Wireless-Guided Missile Launcher (UTML).

Example 7 is a system comprising: a missile launcher operable to receive a first missile; and an adapter configured to couple to the missile launcher, wherein the adapter enables the missile launcher to be operable to receive a second missile different from the first missile.

Example 8 is the system of example 7, wherein the adapter comprises an external surface and an internal surface.

Example 9 is the system of example 8, wherein the external surface comprises: one or more guide pins along a fore portion of the adapter configured to slide through one or more corresponding guide rails on a receiving dual column chassis of the missile launcher; a pilot feature on the fore portion engages with the missile launcher; an extension portion; an electrical interface configured to couple to the missile launcher; and a second retention mechanism configured to retain an aft portion of the adapter in the receiving dual column chassis.

Example 10 is the system of example 8, wherein the internal surface comprises: lower guide rails; a fore alignment pin; a fore strike plate; an electrical interface guide pin; a first retention mechanism; and an aft mechanical stop feature configured to engage the first retention mechanism.

Example 11 is the system of example(s) 7-10, wherein the launcher comprises: side guide rails; a pilot feature; one or more aft capture features; a first electrical interface configured to be coupled to the first missile; and a second electrical interface configured to be coupled to the second missile.

Example 12 is the system of example(s) 7-11, wherein the missile launcher is a modified Upgraded Tube-Launched, Wireless-Guided Missile Launcher (UTML).

Example 13 is the system of example(s) 7-12, wherein the first missile is a Tube-Launched, Optically Tracked, Wire-Guided (TOW) missile.

Example 14 is the system of example(s) 7-13, wherein the second missile is a Spike Long Range 2 (LR2) missile.

Example 15 is a missile launcher configured to receive a first missile and an adapter configured to receive a second missile, the missile launcher comprising: a retainer component configured to transition from a first missile configuration to a second missile configuration, wherein the missile launcher is configured to receive: the first missile in the first missile configuration; and the second missile in the second missile configuration; side guide rails; a pilot feature; one or more aft capture features; a first electrical interface configured to be coupled to the first missile; and a second electrical interface configured to be coupled to the second missile.

Example 16 is the missile launcher of example 15, wherein the pilot feature is configured to be interfaced with a pilot feature on each of the first missile and the adapter.

Example 17 is the missile launcher of example(s) 15-16, wherein the side guide rails are configured to guide guide pins on each of the first missile and the adapter.

Example 18 is the missile launcher of example(s) 15-17, wherein the missile launcher is a modified Upgraded Tube-Launched, Wireless-Guided Missile Launcher (UTML).

Example 19 is the missile launcher of example(s) 15-18, wherein the first missile is a Tube-Launched, Optically Tracked, Wire-Guided (TOW) missile.

Example 20 is the missile launcher of example(s) 15-19, wherein the second missile is a Spike Long Range 2 missile.

The technology described and claimed herein is not to be limited in scope by the specific preferred embodiments herein disclosed, since these embodiments are intended as illustrations, and not limitations, of several aspects of the technology. Any equivalent embodiments are intended to be within the scope of this technology. Indeed, various modifications of the technology in addition to those shown and described herein will become apparent to those skilled in the art from the foregoing description. Such modifications are also intended to fall within the scope of the appended claims.

What is claimed is:

1. An adapter configured to receive a missile therein, the adapter comprising:

a support member comprising an internal surface, an external surface, a fore portion, and an aft portion, wherein the external surface comprises:

one or more guide pins along the fore portion configured to slide through one or more corresponding guide rails on a receiving dual column chassis of a launcher;

a pilot feature on the fore portion engages with the launcher;

an extension portion;

an electrical interface configured to couple to the launcher; and a second retention mechanism configured to retain the aft portion of the adapter in the receiving dual column chassis;

wherein the internal surface comprises:

lower guide rails;

a fore alignment pin;

a fore strike plate;

an electrical interface guide pin;

a first retention mechanism; and an aft mechanical stop feature configured to engage the first retention mechanism.

2. The adapter of claim 1, wherein the support member defines access cutouts that enable access to the internal surface of the support member.

3. The adapter of claim 1, wherein the aft mechanical stop feature comprises a handle locking mechanism configured to engage with the missile.

4. The adapter of claim 1, wherein a central axis of the pilot feature is laterally offset and transversely offset from a central axis of the support member.

5. The adapter of claim 1, wherein the missile is a Spike Long Range 2 (LR2) missile.

6. The adapter of claim 1, wherein the launcher is a modified Upgraded Tube-Launched, Wireless-Guided Missile Launcher (UTML).

7. The adapter of claim 1, wherein the lower guide rails extend along a longitudinal length of the adapter.

8. The adapter of claim 1, wherein the aft mechanical stop feature comprises a locking pin system disposed on the internal surface of the support member.

9. The adapter of claim 1, wherein the first retention mechanism comprises a cross-pin configured to be engaged by the aft mechanical stop feature.

10. The adapter of claim 9, wherein the cross-pin spans a width of the aft mechanical stop feature.

11. The adapter of claim 1, wherein the second retention mechanism comprises spring loaded pins.

12. The adapter of claim 1, wherein the aft mechanical stop feature comprises a single swing bolt style latch.

13. The adapter of claim 1, wherein the aft mechanical stop feature comprises a double swing bolt style latch.

14. The adapter of claim 1, wherein the one or more guide pins comprise a first guide pin on a first side of the support member and a second guide pin on a second side of the support member opposite the first side of the support member.

15. The adapter of claim 1, wherein a central axis of the extension portion is laterally offset from a central axis of the pilot feature.

16. The adapter of claim 1, wherein a central axis of the extension portion is transversely offset from a central axis of the pilot feature.

17. The adapter of claim 1, wherein the electrical interface comprises a connector on the external surface of the support member.

* * * * *